US006045217A

United States Patent [19]

Nagata et al.

[11] Patent Number: 6,045,217

[45] Date of Patent: Apr. 4, 2000

[54] IMAGE RECORDING APPARATUS GASIFYING AND DISCHARGING INK FOR FORMING IMAGE, IMPROVED IN INK LEAKAGE PREVENTION

[75] Inventors: Masaya Nagata; Masayoshi Tsunezawa; Masaaki Ozaki, all of Nara; Kaoru Higuchi, Tenri, all of Japan

[73] Assignee: Sharp Kabushiki Kaisha, Osaka, Japan

[21] Appl. No.: 08/775,992

[22] Filed: Jan. 3, 1997

[30] Foreign Application Priority Data

Jan. 5, 1996 [JP] Japan ..... 8-000249

[51] Int. Cl.[7] ..... B41J 2/04; H05B 3/02

[52] U.S. Cl. ..... 347/55; 219/483

[58] Field of Search ..... 347/111, 120, 347/55, 123, 159, 141, 151, 127, 128, 17, 103, 154; 219/483, 491, 494

[56] References Cited

U.S. PATENT DOCUMENTS 4,975,718 12/1990 Akami et al. ..... 346/140

FOREIGN PATENT DOCUMENTS

| | | |
|---|---|---|
| 56-2020 | 7/1981 | Japan . |
| 59-133064 | 7/1984 | Japan . |
| 61-106261 | 5/1986 | Japan . |
| 02303844 | 12/1990 | Japan . |
| 05104724 | 4/1993 | Japan . |
| 05124222 | 5/1993 | Japan . |

*Primary Examiner*—John Barlow
*Assistant Examiner*—Raquel Yvette Gordon
*Attorney, Agent, or Firm*—David G. Conlin; George W. Neuner; Dike, Bronstein, Roberts & Cushman, LLP

[57] ABSTRACT

An image recording apparatus includes a discharge head and a discharge control device. The discharge head includes an ink chamber with a discharge hole, a first heater for heating and gasifying ink, a shutter unit, provided at the discharge hole portion, controlled to discharge gasified ink intermittently according to an electrical signal corresponding to image data to be recorded, and a first member for maintaining the temperature of the discharge hole sufficiently lower than the temperature of the first heater in operation of the first heater before initiation and after completion of image data recording. The discharge control device controls the shutter unit.

24 Claims, 24 Drawing Sheets

IMAGE RECORDING APPARATUS GASIFYING AND DISCHARGING INK FOR FORMING IMAGE, IMPROVED IN INK LEAKAGE PREVENTION

BACKGROUND OF THE INVENTION

1. Field of the Invention

The present invention relates to image recording apparatuses such as a copying machine, a facsimile, and a printer. Particularly, the present invention relates to an image recording apparatus that forms an image by discharging gaseous ink intermittently and having the ink attached to or permeated selectively on a recording medium, characterized in the structure of a head.

2. Description of the Background Art

As an image recording system of the conventional discharge type, an ink jet system, electrostatic recording system, and the like are known. In an ink jet system, the liquid ink stored in a tank is pressurized with a piezoelectric element by an electrical signal corresponding to image data, whereby ink is discharged from a nozzle.

In an electrostatic recording system, powder or fluid (gaseous) ink is charged to be discharged from a nozzle by electrostatic attraction. Printing is carried out by opening/closing a shutter provided at the leading end of the nozzle according to an electrical signal corresponding to image data.

The technique of attaching ink on a recording medium by discharging gaseous ink is known. This technique is advantageous in that clogging in a nozzle from which gas is discharged seldom occurs. Furthermore, the resolution is high and the gradation superior since the pixel can be recorded in a molecular state. A clear print out with almost no blur can be obtained.

FIG. 1 shows a structure of a conventional image recording apparatus employing the technique of discharging gaseous ink to be attached to a recording medium. This is disclosed in Japanese Patent Publication No. 56-2020.

Referring to FIG. 1, an image recording apparatus includes a print head 201 accommodating ink 203 therein, a charger electrode 204 for charging gaseous ink 203A, a power source 205 connected to charger electrode 204 and print head 201 for supplying power to charger electrode 204, electric field lenses 206 and 207 for converging charged gaseous ink 203A, a back electrode 211 for inducing charged gaseous ink 203A, a recording medium 212 on which an image is recorded, a signal source 210 for supplying an image data signal, and an electric field shutter 215 for controlling the amount of ink discharge according to a signal from signal source 210. Print head 201 includes a heater device 202, and ink 203 that is heated by heater device 202 to attain a gaseous phase. Heater device 202 includes an electric heater 213 and a power source.

In operation, ink 203 inside print head 201 is heated and gasified by heater device 202. The gasified ink 203A is jetted out from print head 201 and charged by charger electrode 204 in passing charger electrode 204. The charged gaseous ink 203A is converged by electric field lenses 206 and 207 and sprayed towards back electrode 211 with the amount of discharge controlled by signal source 210 in passing through electric field shutter 215. The discharged ink forms an image on recording medium 212.

The following problems are encountered in the conventional art. In the ink jet system, there was a problem that pressure becomes insufficient due to air introduced into the ink tank, whereby printing is inhibited. There is also a problem that usage of liquid ink causes ink clogging at the nozzle and ink blur on the recording medium to result in degradation of the picture quality.

In the electrostatic recording system, there was a problem that, when powder ink is used, the ink particles coagulate into blocks to cause clogging. When liquid ink is used, the problems similar to those of the ink jet system such as clogging and blurring are encountered.

In the aforementioned method of attaching ink onto a recording medium by discharging gaseous ink as shown in FIG. 1, the gaseous ink will be constantly be discharged. The running cost is increased since ink not used in recording will be wasted. Furthermore, a device for collecting the gaseous ink not used, and a device for cleaning the surroundings of electric field shutter 215 are required. This is disadvantageous from the standpoint of maintenance and down-sizing of the apparatus. The transfer of gaseous ink 203A from print head 201 is set forth in the following. When ink 203 is gasified, the volume thereof is expanded. The pressure in ink head 201 is increased, whereby gaseous ink 203A is jetted out. Thus the response of a printing operation with respect to a print out command is not so good. The printing operation in response to a printing command is also affected by the amount of ink 203 within print head 201 to result in variation in density. This will degrade the print out quality.

In view of the above problems, there is an approach, as related art, to obtain an image by discharging gasified ink intermittently according to an electrical signal corresponding to image data to be recorded to be attached onto or permeated into a recording medium. An apparatus realizing this method includes a heater device for heating ink, a discharge device for discharging ink, and a discharge control device for providing control to discharge ink intermittently according to an electrical signal corresponding to image data to be recorded.

This method can be implemented by either of the following three procedures. In the first procedures ink is charged and then heated to be gasified. The gaseous ink is discharged by means of a back electrode disposed at the backside of a recording medium. In this case, the ink to be charged is powder or liquid.

As a second procedure, ink is heated to be gasified. The heated gas is charged, so that the gas is discharged by means of a back electrode disposed at the backside of a recording medium. The ink subjected to heating is in the form of powder or liquid.

The apparatus employing the first and second procedures includes a heater device for heating ink, a discharge device for discharging ink, and a discharge control device for providing control to discharge ink intermittently according to an electrical signal corresponding to image data to be recorded. The discharge device includes a charger electrode for charging ink, and a back electrode disposed at the backside of a recording medium for inducing the charged ink onto the recording medium. The discharge control device includes a shutter unit for controlling ink discharge physically or electrically, and a control unit for controlling the shutter unit by providing a signal corresponding to an electrical signal input with respect to image data. The heater unit, the charger electrode unit, and the shutter unit integrally form a print head.

In addition to the first and second procedures, there is a third procedure for electrically controlling ink discharge. The discharge hole of ink is provided with a slit configuration. A plurality of electrodes are provided at both ends at the longer side of the slit hole with a width corresponding to the recording pixel.

Referring to FIG. 2, an image recording apparatus according to the above-described second procedure includes a print head 10 with a discharge hole 14, a heater device 2 with an electric heater 13 for heating and gasifying powder ink 3 in print head 10, a charger electrode 4 for charging gasified ink 3B, a back electrode 11 disposed opposite to discharge hole 14 at the backside of recording medium 12 arranged facing discharge hole 14 for including charged gaseous ink 3B to the recording medium side, an electric field shutter 8 with electric field shutters 8A and 8B, provided at the discharge hole 14 portion, controlled to intermittently discharge gasified ink 3B according to an electrical signal corresponding to image data to be recorded, and a control unit 9 for controlling electric field shutters 8A and 8B. Charger electrode 4 is formed of a thin wire electrode of 50–80 $\mu$m diameter.

Referring to FIG. 3, electric field shutter 8 includes a plurality of discharge holes 14 for gasified ink 3B. Electric field shutters 8A and 8B are provided at either side of discharge hole 14. The plurality of discharge holes 14 are provided over a length corresponding to the printout width. The interval of the discharge holes is 200 $\mu$m with a recording density of 150 dpi. Electric field shutter 8 has one side 8A grounded, and the other provided with electrode 8B in a comb-like manner at the interval of 169 $\mu$m corresponding to the recording density.

Referring to FIG. 2 again, ink 3 is heated by heater device 2 to be gasified in a printout operation. Using colored ink, ink coloring materials set forth in the following can be employed. For yellow, anthra isothiazole type, quinopthalone type, pyrazolone type, pyridone azo type, styryl type, and the like can be used. For magenta, anthraquinone type, dicyano imidazole type, thiadiazole azo type, tricyanovinyl type, and the like can be used. For cyan, azo type, anthraquinone type, napthoquinone type, indoaniline type, and the like can be used.

Ink 3 is gasified to result in gaseous ink 3B. By applying a voltage of +2 to 5 kV to charger electrode 4, corona discharge is induced towards grounded heater device 2. The gaseous ink 3B is charged with plus charges. The charged gaseous ink 3B is induced onto the recording medium as a result of applying a voltage of −0.5 to −2 kV to back electrode 11 arranged at the backside of the printing face of recording medium 12. Electric field shutter 8 is controlled to a allow/prevent passage of gaseous ink 3B by having a voltage of 50 V to 1 kV applied to the electrode by an output signal of control unit 9 corresponding to an electrical signal of image data to be recorded. Gaseous ink 3B passing through electric field shutter 8 is induced by the charger electrode 4 and back electrode 11 to be attached on recording medium 12. Thus, printing is carried out.

Although ink 3 prior to a heating process is described as powder ink, fluid ink can be used. Fluid ink is advantageous in that the transportability is superior and the amount of energy required for gasification is reduced.

Referring to FIG. 4, an image recording apparatus of the above-described first procedure includes a print head 10 with a discharge hole 14A, a heater device 2 with an electric heater 13 for heating and gasifying liquid ink 3A in print head 10, a charger electrode 4A formed of two electrodes for charge injection, provided to sandwich the stored ink 3A for charging liquid ink 3A, a back electrode 11 disposed opposing discharge hole 14A at the backside of recording medium 12 arranged facing discharge hole 14 for inducing charged gasified ink 3B towards the recording medium 12 side, electric field shutters 8A and 8B provided at the discharge hole 14A portion, controlled to discharge gasified ink 3B intermittently according to an electrical signal corresponding to image data to be recorded, and a control unit 9 for controlling electric field shutters 8A and 8B.

Referring to FIG. 5, discharge hole 14A of ink 3B has a slit configuration. Electric field shutter 8 is provided at both lower sides of the slit. This slit has a length corresponding to the printing width. It is approximately 200 mm for A4-size and approximately 140 mm for A5-size, for example. The recording density is 150 dpi, and the slit width is 200 $\mu$m. A slit-shaped discharge hole has the merit that clogging occurs more scarcely than the discharge hole 14 shown in FIG. 3 provided at an interval according to the resolution. Electric field shutter 8 has one side 8A grounded, and the other supplied with an electrode 8B in comb-like manner at an interval of 169 $\mu$m corresponding to the recording density.

Referring to FIG. 4 again, a potential difference of 2 to 5 kV is established across charger electrode 4A to inject charge to ink 3A. As a result, ink 3A is charged with plus charges. By gasifying charged ink 3A by heater device 2, gaseous ink 3B is generated maintaining the charged state. Ink 3B is induced onto a recording medium by back electrode 11 arranged at the backside of the printing face of recording medium 12 by having a voltage of −1 kV applied.

A voltage of generally 50 V to 1 kV is applied to electric field shutter 8, so that passage of gaseous ink 3B is inhibited. By an output signal of control unit 9 corresponding to an electrical signal of image data to be recorded, the potential of electric field shutter 8 corresponding to each pixel is controlled to allow passage of gaseous ink 3B. Gaseous ink 3B passing though electric field shutter 8 is induced by back electrode 11 to be attached on recording medium 12. Thus, printing is carried out.

Although ink 3A prior to a heating process is described as fluid ink, powder ink can also be used. In the case of powder ink, frictional charging, for example, can be used besides the above-described charging method by charge injection. Fluid ink is advantageous over powder ink in that charge variation is small and efficient charging is allowed. Powder ink is characterized in that leakage from print head 1 is low.

The discharge hole of ink 3B may be provided at an interval according to resolution as shown in FIG. 3.

An other example of the electric field shutter unit will be described with reference to FIG. 6. A plurality of discharge holes 14B of gasified ink 3B are provided in an electric field shutter 608. Electric field shutters 608A and 608B are provided above and below each discharge hole 14B. The plurality of discharge holes 14B are provided over a length corresponding to a printout width. For example, it is approximately 200 mm for A4 size and approximately 140 mm for A5 size. The interval of discharge holes 14B is 169 $\mu$m with the recording density of 150 dpi. Electric field shutter 608 is formed of a ring-like electrode formed above and below discharge hole 14B. Electric field shutter 608A has one side grounded and electric field shutter 608B of the other side is connected to a power source of high voltage. When a high voltage is applied to electric field shutter 608B formed of an electrode, an electric field is generated from electric field shutter 608B to electric field shutter 608A. Therefore, discharge of the positively charged ink is prevented. Conversely, when no voltage is applied to electrode 608B, no electric field is generated across both electrodes. Therefore, ink is discharged from discharge hole 14B.

According to the above-described first and second procedures of the related art, discharge of unrequired ink is inhibited due to the gaseous ink discharge operation controlled within the print head. It is characterized by its superior printing efficiency.

Since the image recording apparatus includes a print head with the integral heater device, charger electrode unit, and shutter unit according to the first and second procedures, the possibility of ink adhering to the shutter unit to result in clogging can be alleviated. Furthermore, the device for collecting the attaching ink and the cleaning device are no longer required. Particularly in the second procedure, even ink of an insulating material can be charged and is not easily subjected to environmental influence since gasified ink is charged.

In the first procedure, charging is effected without generation of harmful substances such as ozone since solid or liquid ink is charged and then heated to be gasified. The usage of a slit-shaped discharge hole is advantageous in that clogging is prevented and that it is not necessary to provide a discharge hole for each pixel.

The first and second procedures of the related art have issues set forth in the following. When ink is heated, the pressure within the ink head is increased. If the pressure becomes higher than the outside pressure of the head, there is a possibility that ink will leak out from the slit even when there is no electric field by the back electrode. This will be described in detail with reference to FIGS. 2, 7 and 8.

When an image output signal is transmitted to an image recording apparatus from another information equipment or an operator, a head control signal is transmitted to a head 1 from the CPU of the image recording apparatus. A temperature control device 16 is triggered at the rise (point A) of this signal to drive heater device 2. Here, a voltage of +2 to 5 kV is applied to charger electrode 4.

By actuation of heater device 2, solid or liquid ink 3 is heated and then gasified when the vaporization temperature of $T_g$ is exceeded. The amount of gaseous ink 3B increases over time to arrive at a threshold value at point B'. This threshold value refers to the amount of gaseous ink sufficient for discharge and that enables printing when this value is exceeded. This state also implies that head 1 is filled with gaseous ink 3B of high pressure.

Heater device 2 is controlled by temperature control device 16 so as to achieve a certain temperature T higher than ink vaporization temperature $T_g$. Therefore, $T=T_g+\Delta T$. When ink vaporization temperature $T_g$ is 140° C., T=155° C. with, for example, $\Delta T=15°$ C.

Since electric field shutter 8 is turned off from point B' to point D, gaseous ink particles 3B of high pressure will be discharged due to the pressure difference outside and inside the head even if an electrical force is applied by back electrode 11. The force exerted on the ink is caused by the pressure in the head attaining high pressure, and not by the electrical force from back electrode 11. Therefore, ink particle 3B is discharged by the pressure in the head.

Electric field shutter 8 operates to block and discharge the charged ink particles when turned on and off, respectively. The undesired ink leakage of issue occurs only when electric field shutter 8 is turned off. This ink leakage occurs during point B' to point D corresponding to the OFF state of electric field shutter 8.

At a certain time point of D where printing is enabled, a print start/end signal is output to the control unit of discharge control device 9 from the CPU. The control unit is triggered at the rise of the print start/end signal to request transmission of image data from a memory not shown. At completion of data transfer, an on/off signal corresponding to image data is provided to electric field shutter 8. Electric field shutter is connected to a power source not shown supplying a voltage of 500 V. Application of a voltage of 500 V is conducted/not conducted according to image data. During printing, the print start/end signal maintains a high level.

When printing ends, the print start/end signal attains a low level at point E. Triggered at this falling point, heater device 2, charger electrode 4, electric field shutter 8 and back electrode 11 are all turned off.

Even if the application of a current to the heater is suppressed, gaseous ink 3B that was not discharged and remaining in head 1 is not cooled immediately. Therefore, ink discharge will occur not corresponding to image data due to difference in the pressure outside and inside the head.

Thus, this undesired ink leakage may occur at the two stages of before initiation and after completion of printing.

SUMMARY OF THE INVENTION

An object of the present invention is to provide an image recording apparatus that can prevent unfavorable ink leakage occurring before initiation and/or after completion printing.

According to an aspect of the present invention, an image recording apparatus includes a discharge head, and a discharge control device for controlling a shutter unit. The discharge head includes an ink chamber with a discharge hole, a first heater unit for heating and gasifying ink in the heat chamber, a charger electrode for charging ink, a back electrode disposed opposite to the discharge hole at the backside of a recording medium arranged facing the discharge hole for inducing charged gasified ink to the recording medium side, a shutter unit provided at the discharge hole portion, controlled to discharge gasified ink intermittently according to an electrical signal corresponding to image data to be recorded, and a first member for maintaining the temperature of the discharge hole in operating the first heater unit low enough than the temperature of the first heater unit before initiation and after completion of image data recording.

In the image recording apparatus according to the present invention, the first heater unit heats and gasifies the ink in the ink chamber having a discharge hole. The charger electrode charges the ink. The back electrode induces the charged gasified ink to the recording medium side. The shutter unit discharges the gasified ink intermittently according to an electrical signal corresponding to image data to be recorded. The first member maintains the temperature of the discharge hole during the operation of the first heater unit sufficiently lower than the temperature of the first heater unit before initiation and after completion of image data recording. The discharge control device controls the shutter unit.

The temperature of the discharge hole is maintained lower than the temperature of the first heater unit. Ink will not leak out from the discharge hole since increase of the pressure of the ink chamber in the proximity of the discharge hole is lowered. Therefore, unfavorable ink leakage occurring before initiation and after completion of printing can be prevented effectively.

Preferably, the first member includes a thermal insulation member provided between the first heater unit and the shutter unit for thermally isolating the first heater unit from the shutter unit.

The thermal insulation member isolates the first heater unit from the shutter unit. Therefore, the temperature of the discharge hole is maintained sufficiently lower than the temperature of the first heater unit. This effectively prevents the unfavorable occurrence of ink leakage before initiation and after completion of printing.

The discharge head can further include a second heater unit for heating the shutter unit until the temperature of the discharge hole becomes approximately equal to the temperature of the first heater unit.

It is possible to operate the second heater unit during printing, and inhibit the operation of the second heater unit before initiation and after completion of printing. As a result, unfavorable ink leakage occurring before initiation and after completion of the printing can be prevented effectively.

According another aspect of the present invention, an image recording apparatus includes a discharge head and a control unit. The discharge head includes an ink chamber with a discharge hole, a first heater unit for heating and gasifying ink in the ink chamber, a charger electrode for charging ink, a back electrode provided opposite to the discharge hole at the backside of the recording medium arranged facing the discharge hole for inducing the charged gasified ink to the recording medium side, and a thermal shutter unit for discharging gasified ink intermittently according to an electrical signal corresponding to image data to be recorded by heating until the temperature of the discharge hole becomes substantially equal to the temperature of the first heater unit, or by suppressing the heating operation. The control unit controls the thermal shutter unit.

According to this image recording apparatus, the first heater heats and gasifies the ink in the ink chamber with the discharge hole. The charger electrode chargers the ink. The back electrode induces the charged gasified ink to the recording medium side. The thermal shutter unit discharges the gasified ink intermittently by heating until the temperature of the discharge hole becomes substantially equal to the temperature of the first heater unit, or by suppressing the heating operation. The control unit controls the thermal shutter unit.

When the discharge hole is heated by the thermal shutter unit, the temperature of the discharge hole becomes substantially equal to the temperature of the first heater unit. Therefore, ink can be discharged from the discharge hole. The temperature of the discharge hole can be maintained sufficiently lower than the temperature of the first heater unit when the thermal shutter unit inhibits the heating operation. Ink will not leak out from the discharge hole since increase of pressure in the ink chamber in the proximity of the discharge hole is suppressed. Therefore, unfavorable ink leakage occurring before initiation and after completion of the printing can be prevented effectively.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

In order to carry out printing according to the first and second procedures of the related art described above, the interior of the print head must be filled with gaseous ink 3B in advance. The pressure in a print head 1 will be increased due to gasification of heated ink. When the pressure inside the head become higher than the pressure outside the head, ink will leak out from the slit even when there is no electric field by a back electrode. The present invention is directed to suppress pressure increase of gaseous ink by controlling the temperature of the ink discharge portion independent of the ink heating temperature to reliably provide intermittent ink discharge corresponding to an electrical signal.

An experiment showing the effectiveness of the method of suppressing pressure increase of gaseous ink by controlling the temperature of the ink discharge portion independent of the ink heating temperature will be described with reference to the drawings.

Figure 9:
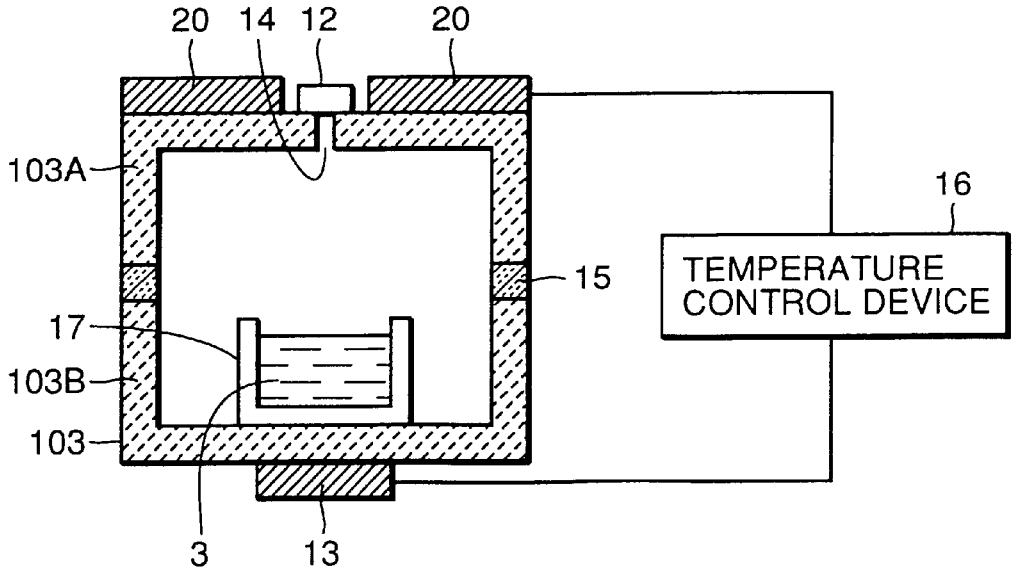
FIG. 9 is a schematic diagram of an experiment apparatus according a first embodiment of the present invention.

Referring to FIG. 9, an apparatus of this experiment to prove effectiveness of the method of suppressing pressure increase of gaseous ink according to the present invention includes an upper head 103A with a slit as an ink discharge hole 14, and including a second heater 20, a lower head 103B attached with a heater 13 to heat sublimation ink, a thermal insulation member 15 disposed between upper and lower heads 103A and 103B to avoid thermal influence therebetween, and a heat control device 16 for driving heater 13 so that ink 3 is heated to a temperature higher than the sublimation temperature, and controlling the temperature in the proximity of discharge portion by a second heater 20.

Lower head 103B includes a ink case 17 in which powder paint ink 3 is accommodated. Upper head 103A includes a photosensitive paper 12 for dye arranged upon its slit.

Using this experimental apparatus, the result of the experiment to identify the level of ink leakage with respect to temperature $T_s$ of the ink discharge portion will be described hereinafter.

First, a current is applied to heater 13 to heat ink 3. Ink 3 is heated to a temperature higher than 160° C., so that head 103 is filled with gaseous ink 3B. Here, the temperature in the proximity of the discharge hole of upper head 103A was $T_s$=50° C. No transfer of dye onto photosensitive paper 12 was recognized.

Then, second heater 20 was energized to raise temperature $T_s$ to confirm whether dye is transferred onto photosensitive paper 12. No ink discharge was recognized until the temperature of the discharge portion became $T_s$=100° C. when the ink heating temperature $T_i$ was 160° C. When the temperature reached $T_s$=160° C., significant ink discharge was recognized. When $T_s$=100° C. to 160° C., for example, $T_s$=135° C., ink discharge was recognized/not recognized from case to case. It is therefore considered that the threshold temperature $T_{th}$ of discharge occurrence exists in the proximity of $T_s \approx 135°$ C.

According to the result of the above experiment, undesired ink discharge can be prevented due to pressure within the head by providing an ink head where the temperature $T_s$ of the ink discharge portion is $\leqq 100°$ C.

The head should be designed taking into consideration material and structure so that temperature $T_s$ of the ink discharge portion is sufficiently lower than ink heating temperature $T_i$. For example, means set forth in the following can be considered. Referring to FIG. 9, a head can be formed with a thermal insulation member 15 interposed between lower head 103B in which ink heater 13 is arranged and upper head 103A with ink discharge hole 14. Alternatively, upper hand 103A per se when an ink discharge hole is provided can be formed of a thermal insulation member. It is effective to control the temperature of the ink discharge hole by the heating operation.

In the case of a head where there is no definite difference between ink heating temperature $T_i$ and ink discharge portion temperature $T_s$, measures for reducing temperature $T_s$ of the ink discharge portion as set forth in the following is to be applied.

a) A heater device for heating the ink discharge portion is to be provided for a head where ink heating temperature $T_i$>ink discharge temperature $T_s$.

b) A cooling device for cooling the ink discharge portion is to be provided for a head where ink heating temperature $T_i \approx$ink discharge portion temperature $T_s$.

For the sake of convenience, the head of the above (a) is referred to as a "heating head", and the head of (b) is referred to as a "cooling head" hereinafter. An image recording apparatus according to a first embodiment will be described hereinafter independently with a heating head and a cooling head.

(1) An image recording apparatus with a heating head

An image recording apparatus employing a heating head will be described hereinafter with reference to FIGS. 10, 11, 12 and 13. In the present invention, a heating head refers to a head where ink heating temperature $T_i$>ink discharge portion temperature $T_s$ due to poor thermal conductance, and that allows undesired ink from being discharged by providing a heater device for heating the ink discharge portion.

Figure 13:
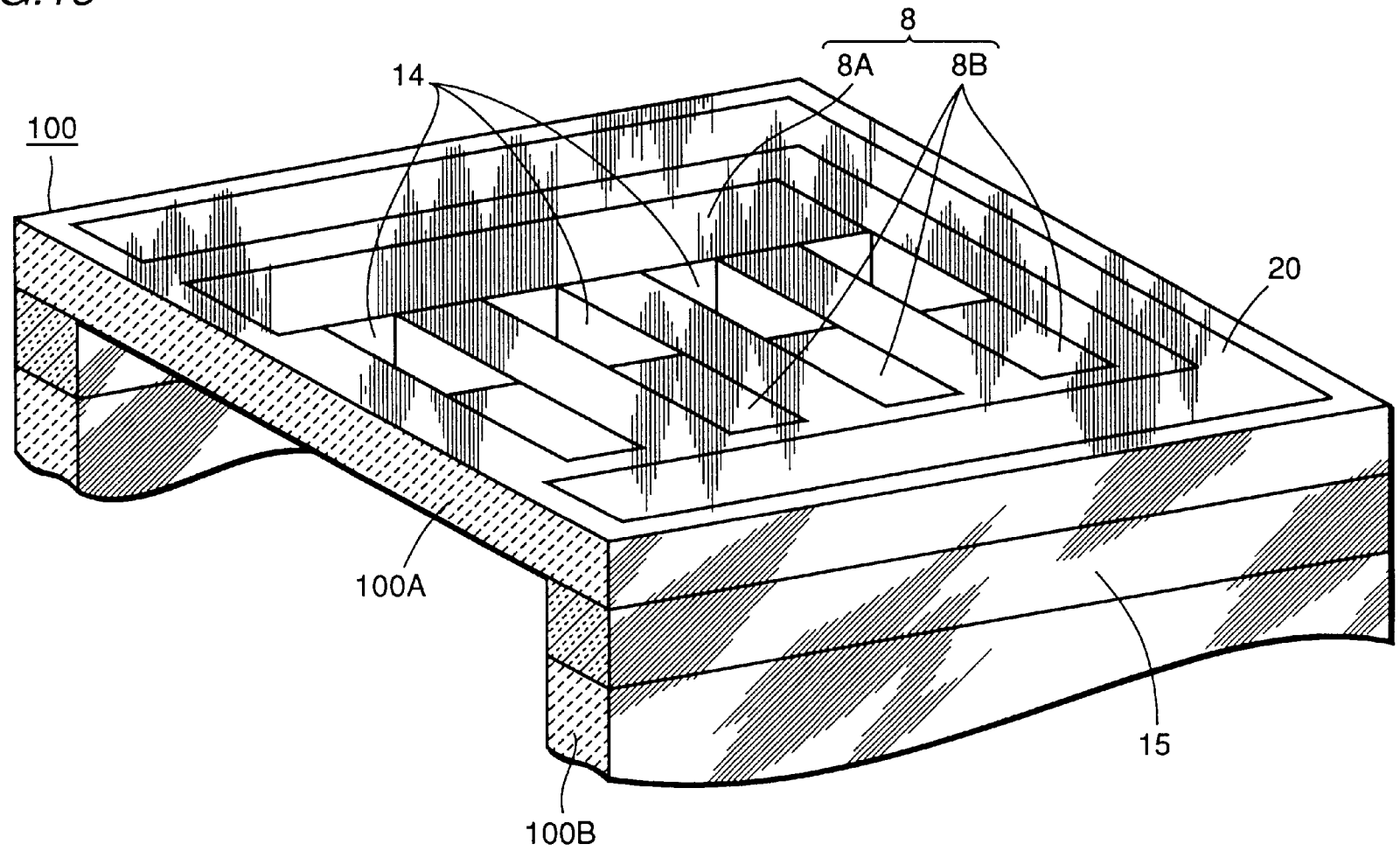
FIG. 13 is a perspective view of main parts of an image recording apparatus employing a heating head according to the first embodiment of the present invention.

A heating head can be realized by using a material of poor thermal conductance for the head material. Also, a heating head can be realized by interposing a thermal insulation member 15 between upper and lower heads 100A and 100B as shown in FIG. 13.

A thermal insulation member can include ceramics such as alumina ($Al_2O_3$), beryllia (BeO), magnesia (MgO), metal oxide such as sapphire ($Al_2O_3$), quartz ($SiO_2$), rutile ($TiO_2$), glass group such as quartz glass, soda glass and borosilicate glass, or rubber or plastic with heat resistant property can be used. They have the thermal conductivity of $\lambda$=0.1 to 0.4 [W/m·K], applicable as a thermal insulation member.

Conversely, copper, aluminum, or an alloy thereof ($\lambda$=200 to 400 [W/m·K]) are known as members with high thermal conductivity.

Figure 1:
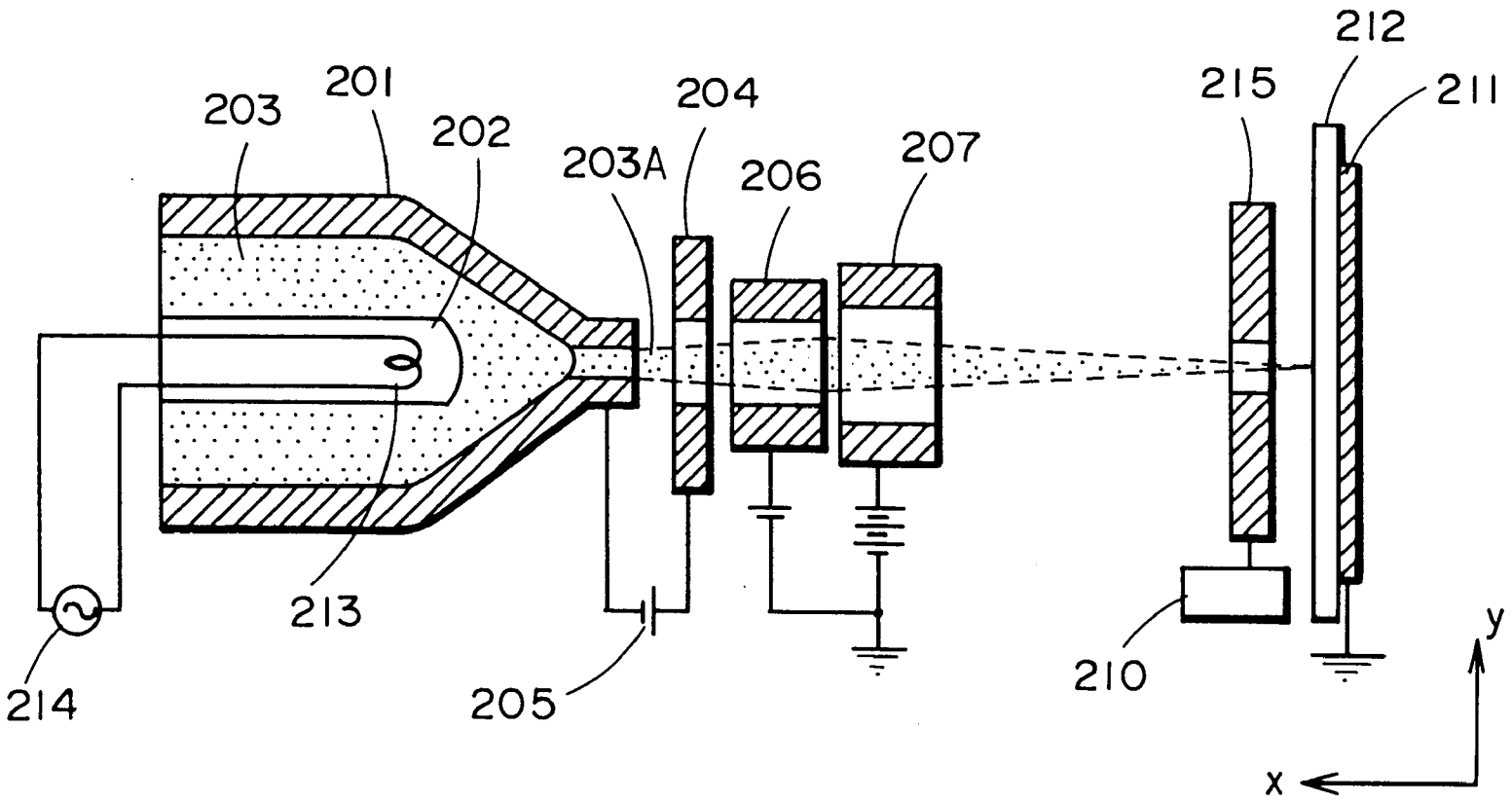
FIG. 1 PRIOR ART
FIG. 1 is a diagram showing an entire structure of a conventional image recording apparatus.
Figure 2:
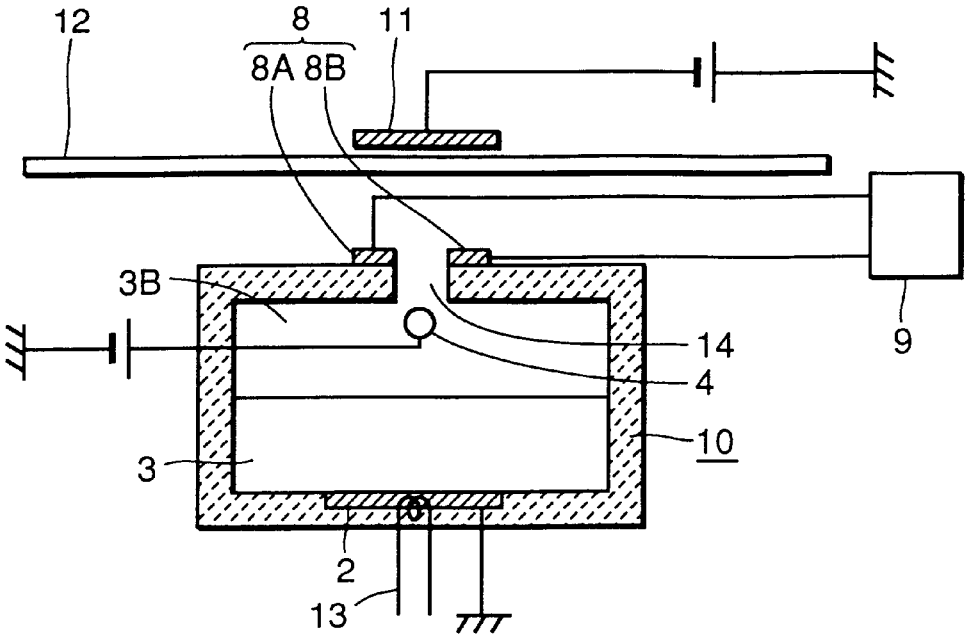
FIG.2 RELATED ART
FIG. 2 shows an entire structure of an example of an image recording apparatus of related art.
Figure 3:
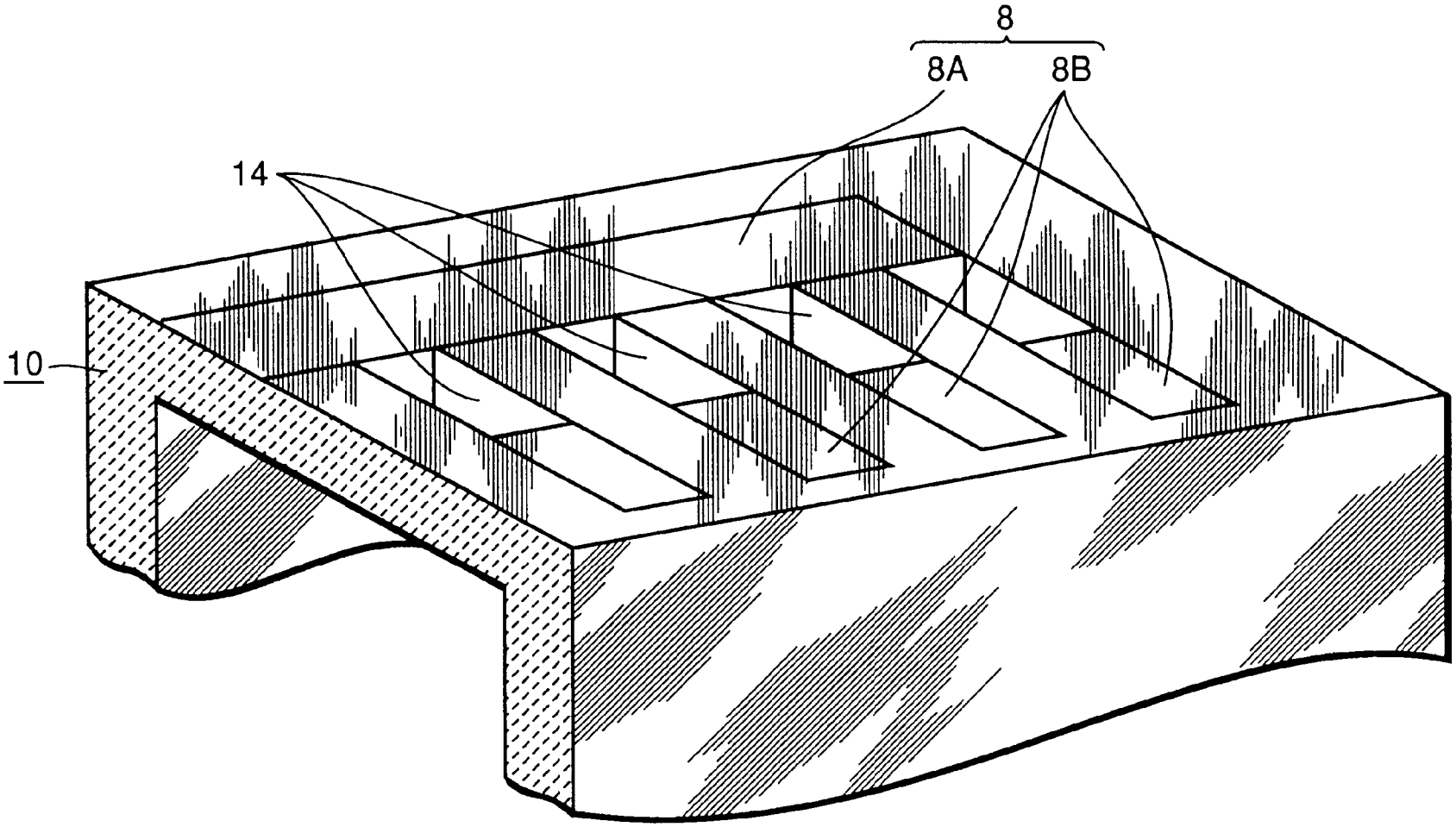
FIG.3 RELATED ART
FIG. 3 is a perspective view of an example of an electric field shutter unit of related art.
Figure 4:
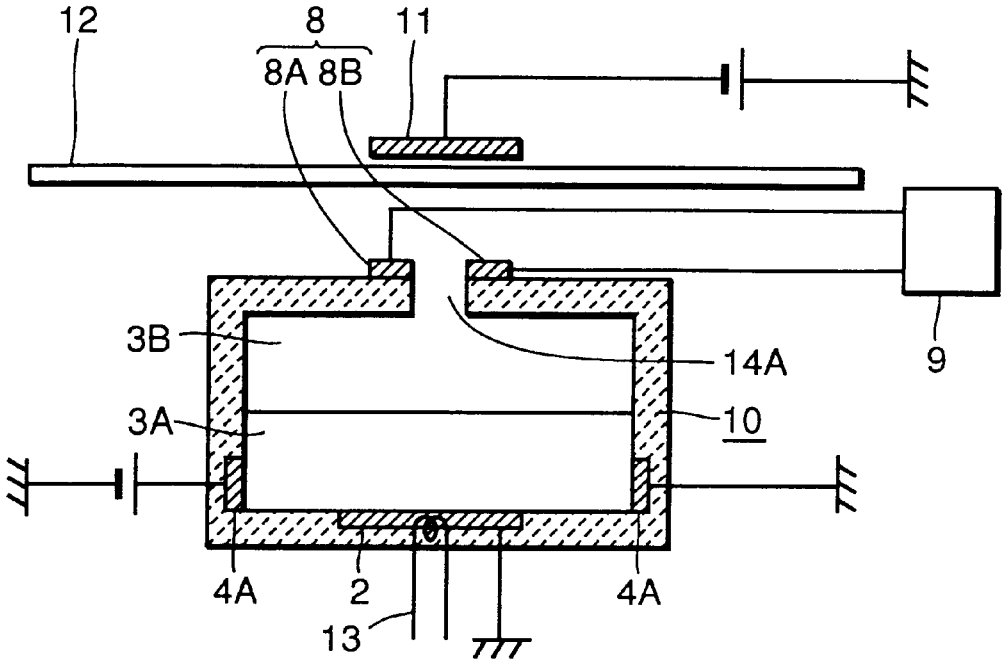
FIG.4 RELATED ART
FIG. 4 shows an entire structure of an example of an image recording apparatus of related art.
Figure 5:
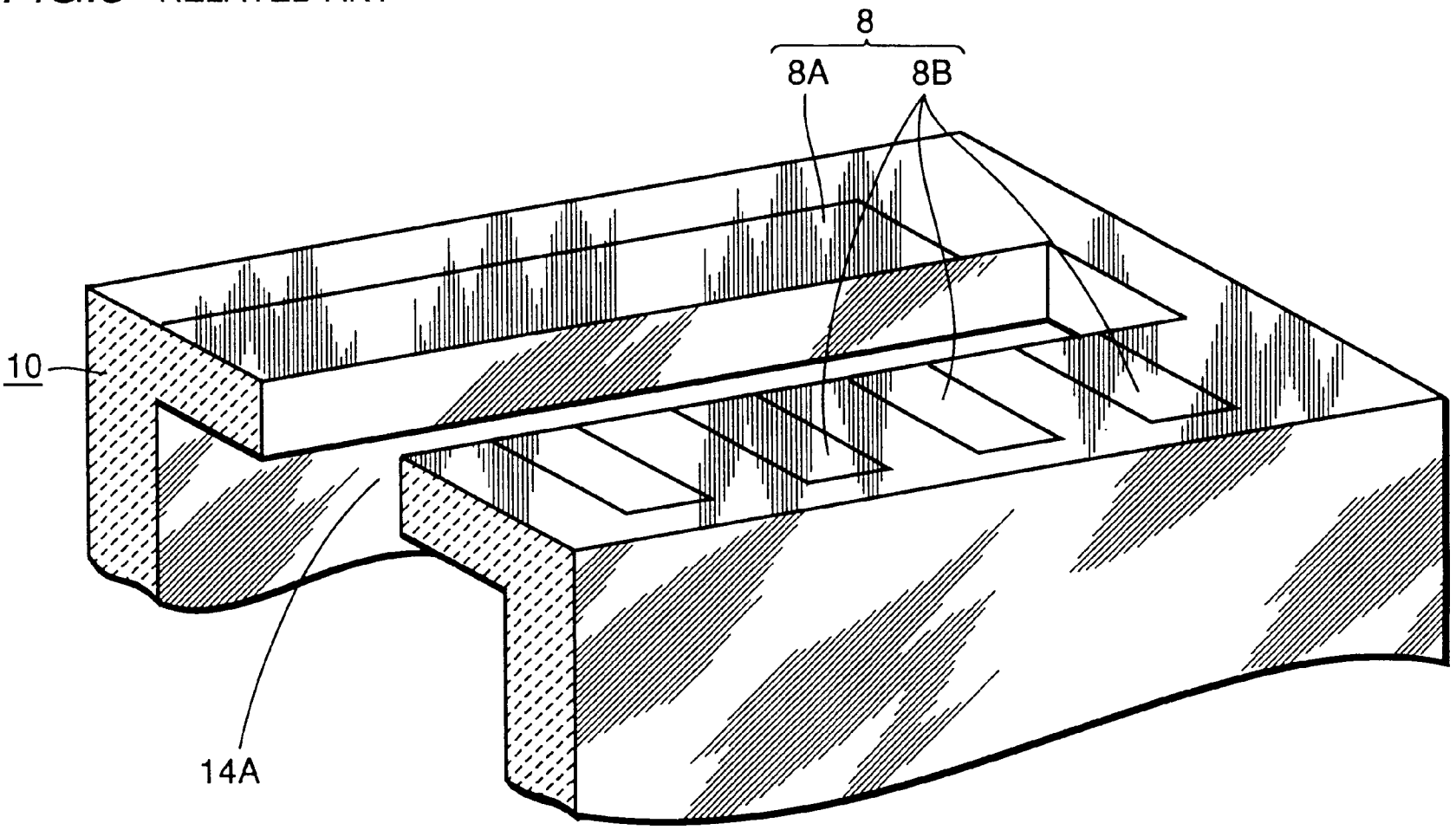
FIG.5 RELATED ART
FIG. 5 is a perspective view showing another example of an electric field shutter unit of related art.
Figure 6:
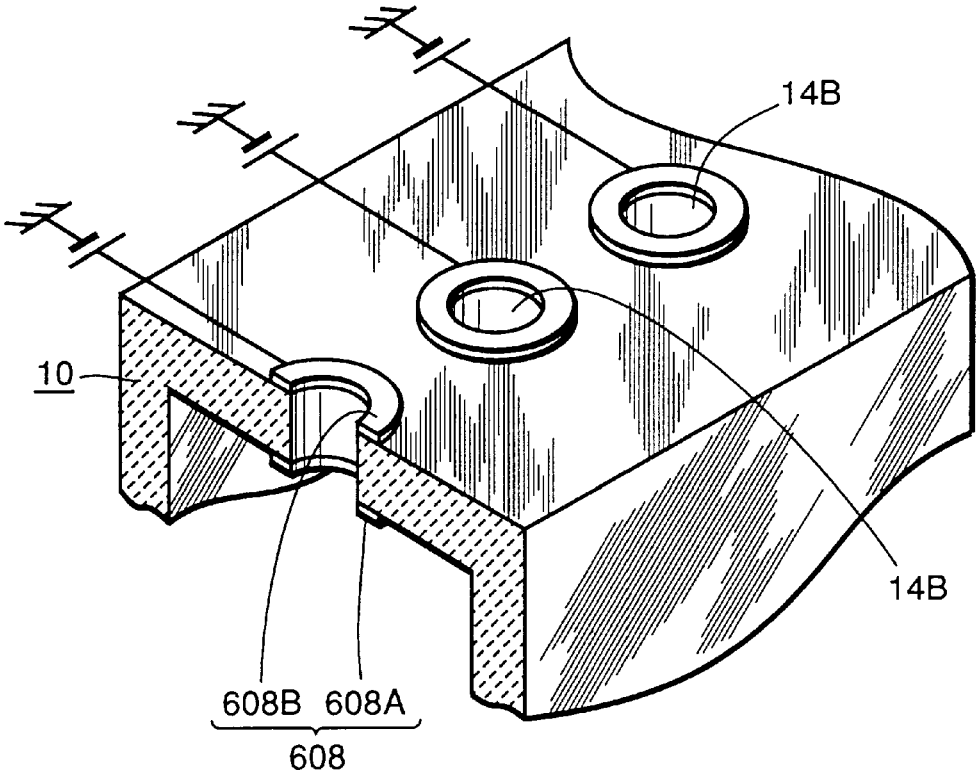
FIG.6 RELATED ART
FIG. 6 is a perspective view showing a further example of an electric field shutter unit of related art.
Figure 7:
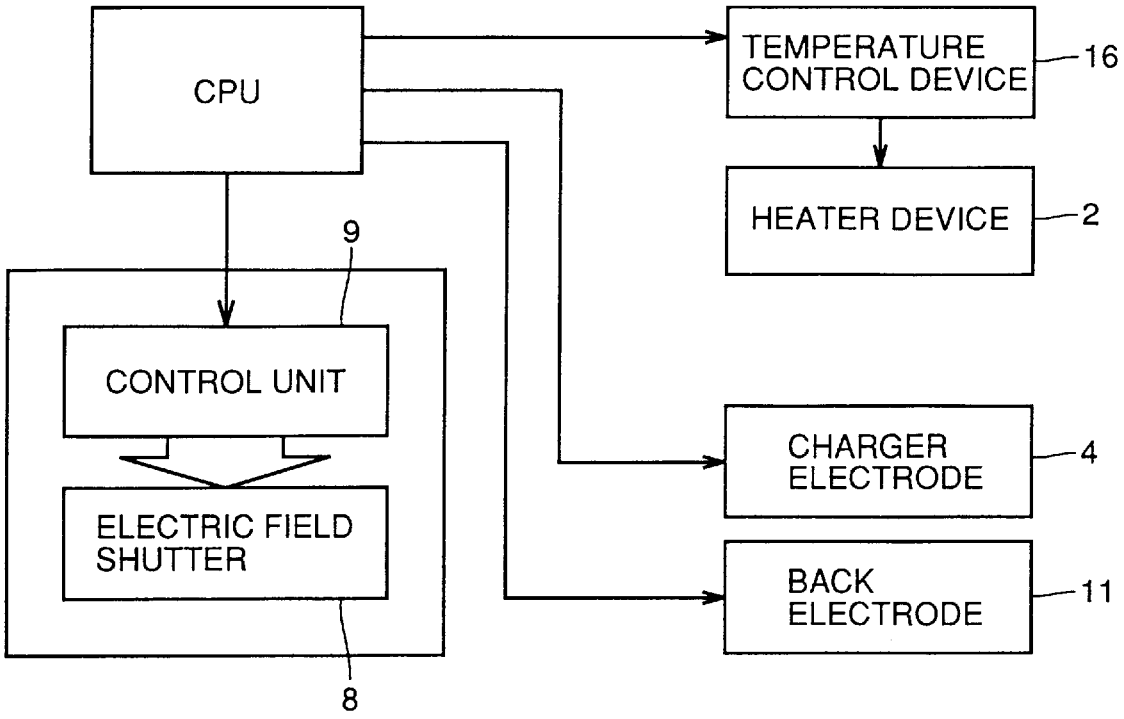
FIG.7 RELATED ART
FIG. 7 shows the main signal flow of an image recording apparatus of related art.
Figure 8:
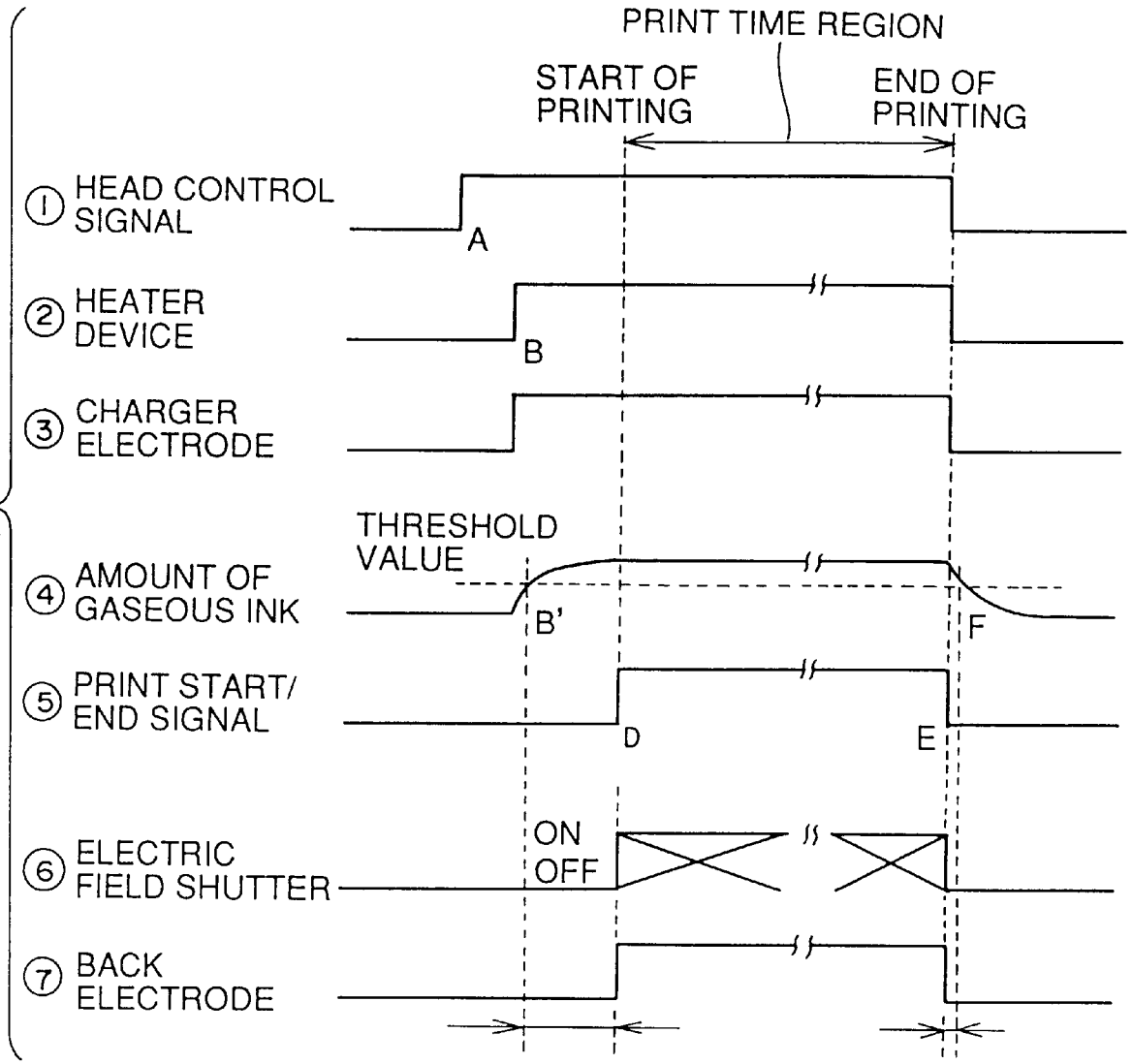
FIG.8 RELATED ART
FIG. 8 shows an operation timing of an image recording apparatus of related art.
Figure 10:
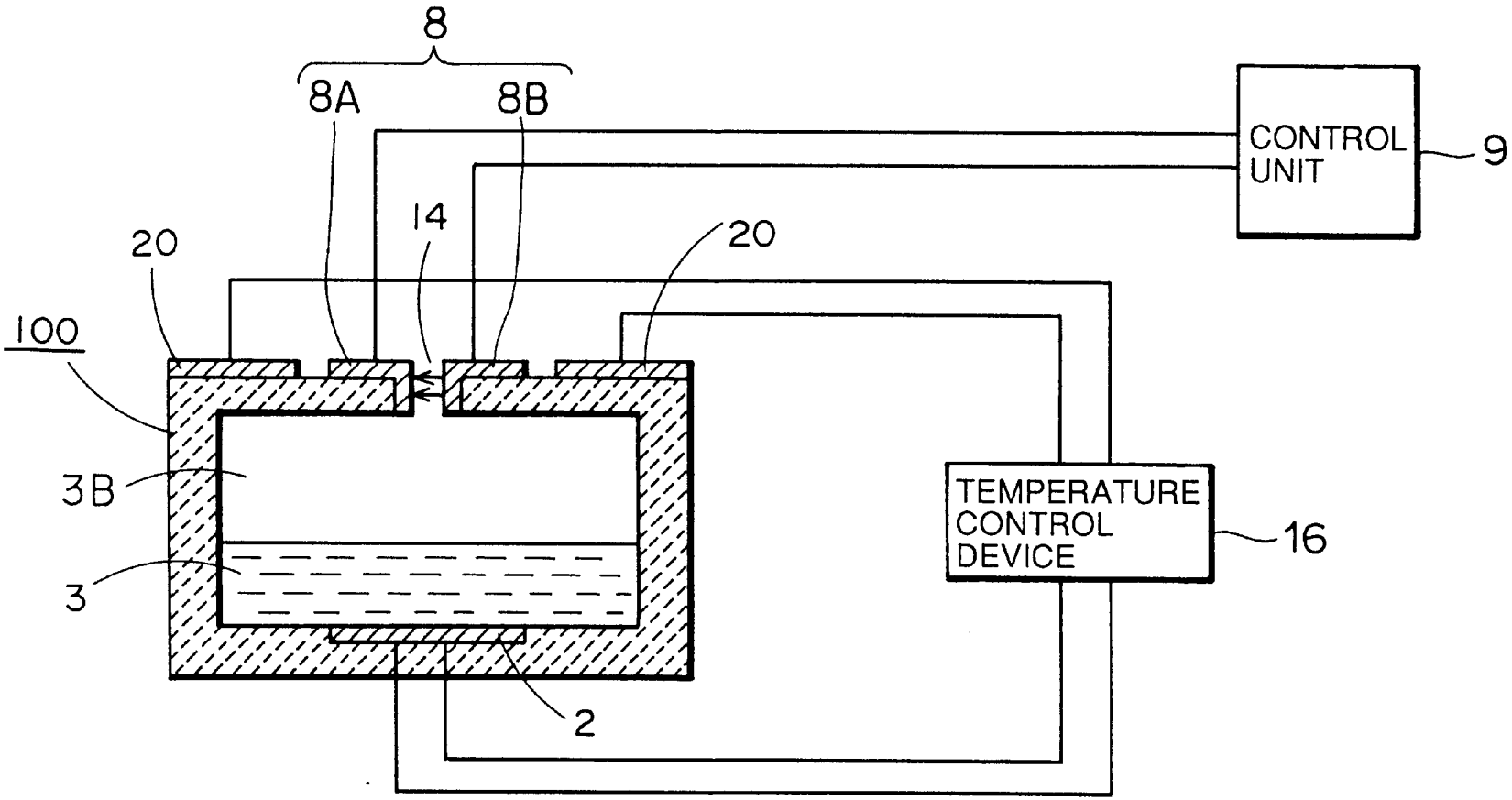
FIG. 10 shows an entire structure of an image recording apparatus according to a first embodiment of the present invention.

Referring to FIG. 10, an image recording apparatus includes a print head 100 with a discharge hole 14, a heater device 2 for heating and gasifying powder ink 3 in print head 100, an electric field shutter 8 formed of electric field shutters 8A and 8B provided at discharge hole 14 portion, controlled to discharge gasified ink 3B intermittently according to an electrical signal corresponding to image data to be recorded, a control unit 9 for controlling electric field shutters 8A and 8B, a heat second heater device 20 for heating discharge hole 14, a temperature control device 16 for controlling first heater 2 and second heater 20, a charger electrode (not shown) for charging ink, and a back electrode 11 (not shown) disposed opposite to discharge hole 14 at the backside of a recording medium 12 (not shown) arranged facing discharge hole 14 for inducing charge gasified ink towards recording medium 12. Charger electrode 4, back electrode 11, and recording medium 12 are common to those of the related art described before with reference to FIGS. 2 and 4. For the sake of simplification, they are not illustrated in FIG. 10.

Figure 11:
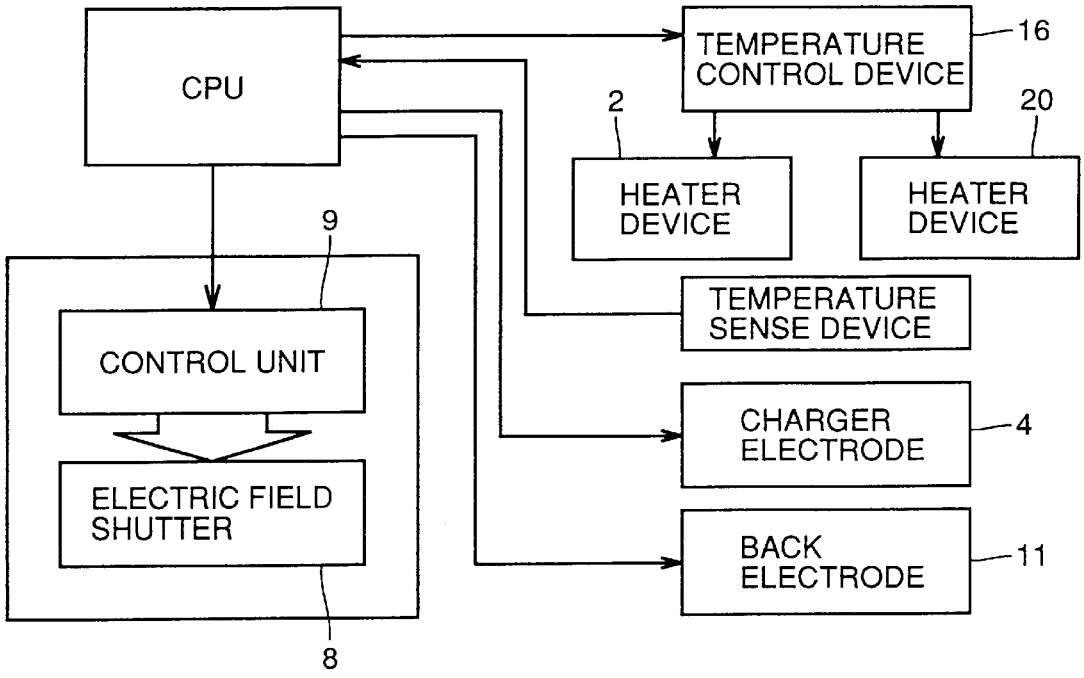
FIG. 11 shows the main signal flow of an image recording apparatus employing a heating head according to the first embodiment of the present invention.
Figure 12:
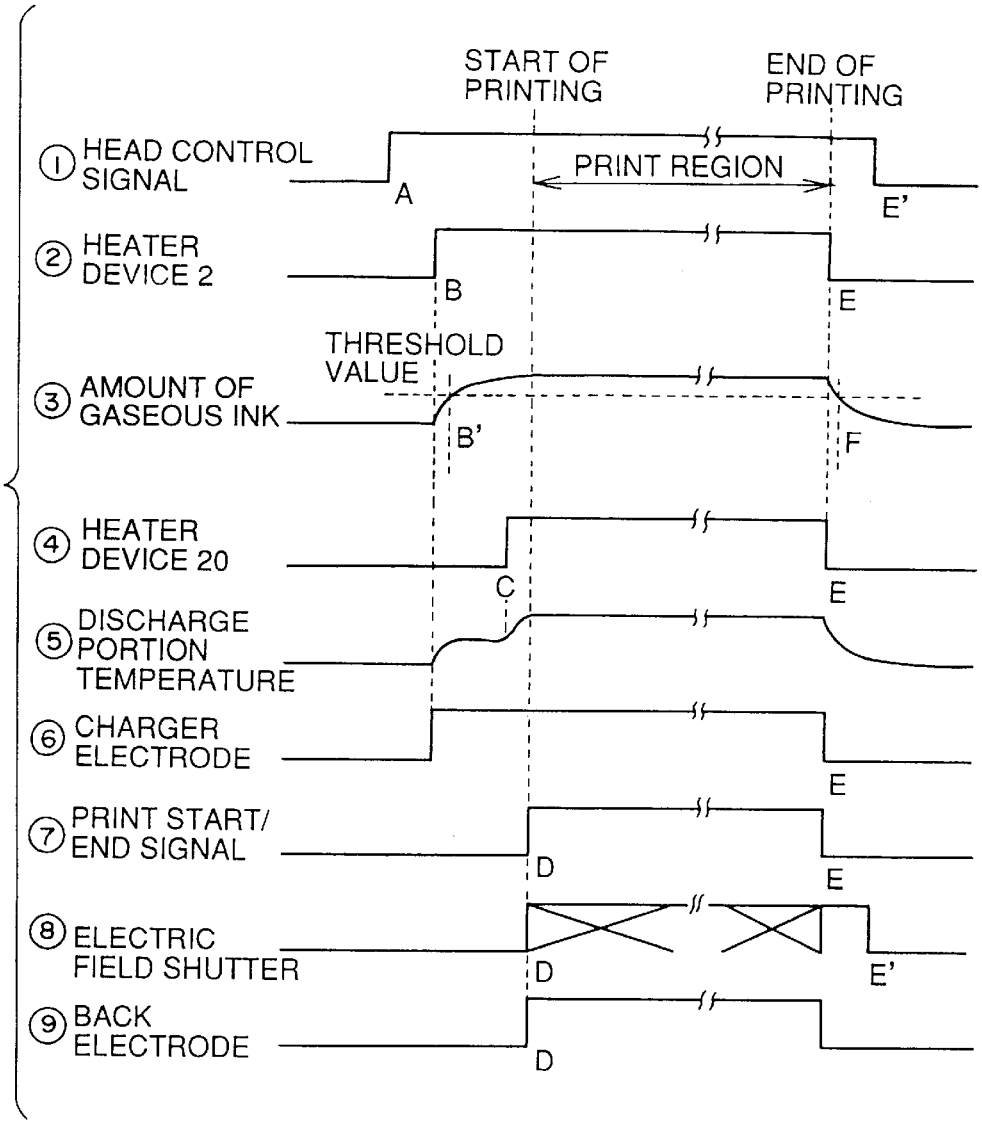
FIG. 12 is a timing chart showing the operation of the image recording apparatus employing a heating head according to the first embodiment of the present invention.

Referring to FIGS. 11 and 12, in response to output of a head control signal from a CPU (not shown), temperature control device 16 drives first heater device 2 located in printer head 100 at point B, whereby sublimation ink 3 is heated. Ink 3 begins to be gasified when the temperature exceeds ink vaporization temperature $T_g$. Eventually, print head 1 is filled with gaseous ink 3B (after point B').

The heating head of the first embodiment has electric field shutter 8 and second heater 20 provided at the upper portion of the ink head where the ink discharge portion is formed, as shown in FIG. 10.

Figure 14:
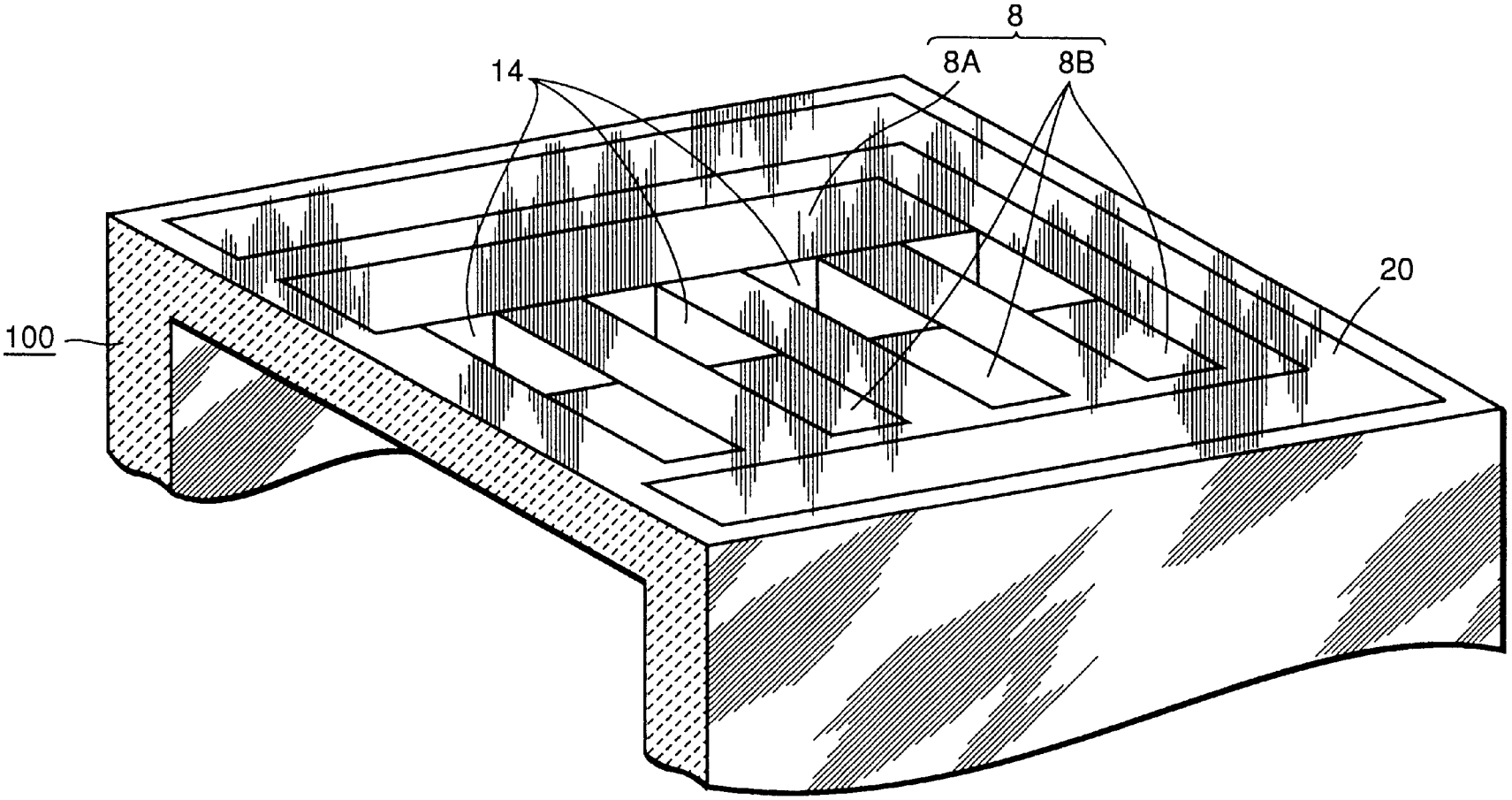
FIG. 14 is a perspective view of the main components of an image recording apparatus according to the first embodiment of the present invention.

Referring to the perspective view of FIG. 14, heater 20 is provided so as to surround the slits so that the temperature of the upper portion of the ink head, particularly, in the proximity of the slits, can be controlled uniformly. By isolating thermally the lower portion of the ink head where heater 2 is arranged from the upper portion of the ink head where the ink discharge hole is formed, and by forming the upper portion of the ink head of a member of favorable thermal conductivity, the effect of controlling the temperature of the upper portion of the ink uniformly can further be improved.

Referring to FIG. 12 again, if a print command is issued by an operator or another information equipment towards the image recording apparatus, it causes a head control signal to be transmitted from the CPU of the image recording apparatus to print head 100. This signal indicates a disabled state of the head when attaining a low level and an enable state of the head when attaining a high level. Temperature control device 16 is triggered at a rise of the signal (point A) to drive first heater 2 at point B. Here, a voltage of +2 to 5 kV is applied to charger electrode 4.

Solid or liquid ink 3 is heated by first heater device 2 being energized. Ink 3 is gasified when the temperature exceeds vaporization temperature $T_g$. The amount of gaseous ink 3B increases over time to arrive at a threshold value at point B'.

First heater device 2 is controlled so that ink heating temperature $T_i$ becomes higher than ink vaporization temperature $T_g$. For example, when ink vaporization temperature $T_g$ is 140° C. at $T_i=T_g+\Delta T$, control is provided so that $T_i$=155° C. with $\Delta T$=15° C.

Even if the temperature at the lower portion of the ink head is higher than the ink vaporization temperature, ink discharge portion temperature $T_s$=60° C. since a heating head is employed that generates a great temperature difference between the lower portion of the ink head and the ink discharge portion. As described above, ink will not be discharged even when first heater 2 is driven if the temperature of the ink discharge portion is sufficiently lower than the ink vaporization temperature.

At time point C where printing is enabled, the CPU generates a control signal to temperature control device 16 so that second heater 20 is driven.

In the first embodiment, determination of whether the amount of gaseous ink has exceeded a threshold value is effected by detecting the temperature of the head. The amount of gaseous ink is not directly measured. More specifically, at the experiment stage, the amount of generated gaseous ink with respect to the head temperature T above the ink vaporization temperature $T_g$ is measured in advance to identify the characteristics of head temperature-gaseous ink generated amount. The head threshold temperature $T_{th}$ where a sufficient amount of gaseous ink for discharge is obtained is identified in advance. Measurement of the gaseous ink is carried out by actually having ink discharged onto the photo sensitive paper and measuring the density thereof. The head temperature where the required density is obtained is set as $T_{th}$.

The image recording apparatus is provided with a head temperature sense device, a thermistor, for example. By identifying the head temperature with this thermistor and comparing the head temperature with the aforementioned threshold value temperature $T_{th}$, the amount of gaseous ink can be obtained indirectly, so that a control signal for driving second heater 20 can be generated.

Temperature control device 16 controls heating of second heater 20 on the basis of this signal so that ink discharge portion temperature is T=155° C. The temperature of the ink discharge portion is provided to the CPU according to the head temperature detect device provided in the proximity of the head discharge portion. The CPU generates a print start/end signal at a point D where a target value temperature, for example T=155° C. is reached. The print start/end signal indicates that the head attains a non-print state and a print state at a low level and a high level, respectively.

Referring to FIGS. 11 and 12, image data is transmitted from a memory not shown to control unit 9, triggered at a rise of a print start/end signal. At completion of data transfer from the memory, control unit 9 provides an on/off signal to electric field shutter 8 according to image data. Electric field shutter 8 is connected to a power source not shown that supplies a voltage of 500 V. Application of a voltage 500 V is turned on/off according to image data. Simultaneous to initiation of the ON/OFF of electric field shutter 8, printing is initiated in response to a voltage of −1 kV being applied to the back electrode.

Since the head is provided so that the temperature of the ink discharge portion becomes lower than the ink heating temperature before printing is commenced, the problem of character blurr due to ink leakage at time point B to D prior to initiation of printing is eliminated. Furthermore, the temperature of the ink discharge portion is controlled to provide an ink dischargeable state at the time of print initiation. Therefore, selective printing can be carried out by the electrical Coulomb force of the back electrode and by ON/OFF switching of electric field shutter 8.

During printing, heater devices 2 and 20 are both operated to maintain facilitation of ink discharge while voltage is selectively applied to a plurality of control electrodes of electric field shutter 8 to control discharge and blocking of ink.

A similar effect can be obtained by having heater device 2 constantly driven during power on of the image recording apparatus and having heater device 20 driven only at the time of printing.

The method of controlling the electric field shutter and ink discharge portion temperature after completion of printing will be described hereinafter. Referring to FIG. 12, the print start/end signal attains a low level at point B when printing ends. With this falling timing as a trigger, first and second heater devices 2 and 20 and charger electrode 4, and back electrode 11 are turned off. At the time point when printing ends, gaseous ink 3B, i.e. ink of high pressure is present in print head 1. Therefore, when the operation of electric field shutter 8 is turned off, there will be a disadvantage that ink 3B attaining a high energy state will leak out from the ink discharge hole irrespective of the value of the back electrode.

Therefore, control is provided to block ink discharge by applying a voltage to all the control electrodes of electric field shutter 8 when there is still gaseous ink 3B (of high energy state) within print head 1 even after printing is completed.

By inhibiting the current application to first and second heater devices 2 and 20, gaseous ink 3B is effectively cooled by the heat dissipation of the radiation plate immediately following suppression of gasification of solid ink 3. Ink 3B gradually loses its kinetic energy to attain a mist phase. The ink will further be converted into a liquid phase (ink 3A) to eventually become solid-phase ink 3 at an elapse of time. Ink of a mist phase as well as ink of completely liquid or solid phase is significantly reduced in its kinetic energy. The problem of leaking outwards is eliminated when there is no difference between the pressure inside and outside print head 1.

By identifying the temperature of this state by experiments in advance and turning off electric field shutter 8, i.e. setting the voltage applied to electric field shutter 8B to 0 V (L) when the signal from a temperature-voltage conversion circuit calibrated using a temperature sense device such as a thermistor arrives at an appropriate temperature, for example T=60° C., undesired ink discharge can be prevented.

Heater device 2 may be constantly driven when the power source of the image recording apparatus is turned on and have heater device 20 turned off only when printing is completed.

Figure 15:
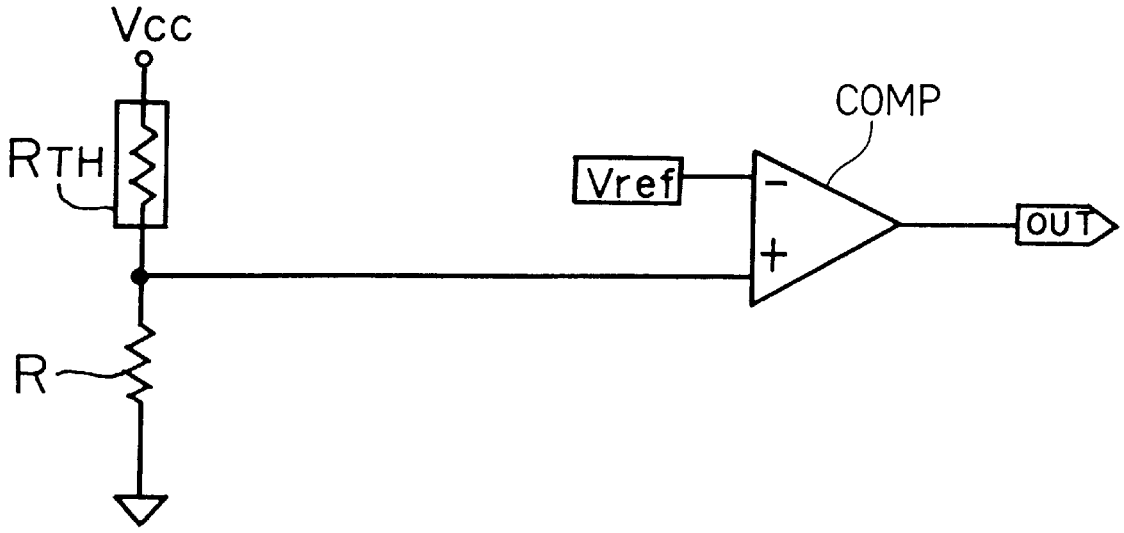
FIG. 15 shows an example of a temperature detecting method according to the first embodiment of the present invention.

The temperature detect device will be described in detail with reference to FIG. 15. A thermistor $R_{Th}$ and a resistor R are connected in series. Thermistor $R_{TH}$ has another terminal connected to power supply Vcc, and resistor R has another terminal grounded. The connection node of thermistor $R_{TH}$ and resistor R is connected to the non-inverting input of a comparator COMP. The inverting input of compactor COMP is connected to a reference voltage $V_{REF}$. Comparator COMP compares the voltage level of the inverting and non-inverting inputs, and operates so that:

output=high level: when (voltage value of inverting input) >(voltage value of non-inverting input) and output=low level: when (voltage value of inverting input) <(voltage value of non-inverting input).

Figure 16:
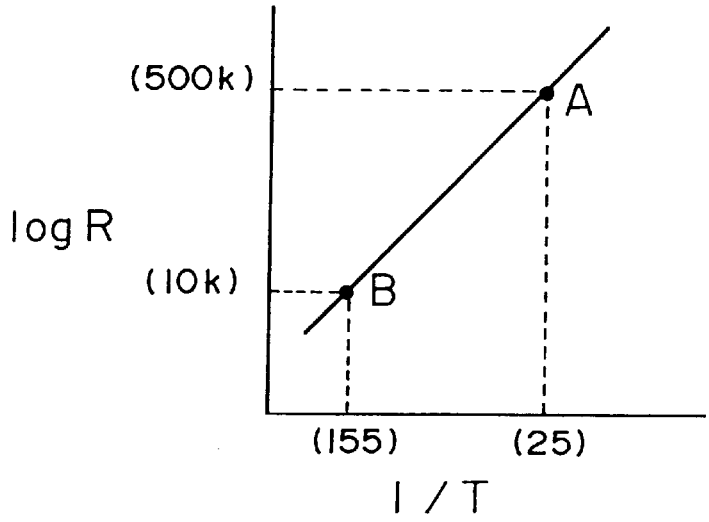
FIG. 16 is a graph showing an example of the temperature characteristics of a thermometer element according to the first embodiment of the present invention.

Referring to FIG. 16, the thermistor resistance value at the room temperature, for example, T=25° C., is provided at point A, which is $R_{25}$=500 kΩ. The resistance at the ink heating temperature, for example T=150° C., is applied at point B, which is $R_{155}$=10 kΩ. Therefore, according to the circuit configuration of FIG. 15, with Vcc=5 V, R=10 kΩ, $V_{ref}$=2.5 V, $R_{TH}$=500 kΩ at T=25° C. Therefore, the voltage of the non-inverting input becomes $V_{+(25)}$=0.1 V by $V_+=Vcc \cdot R/(R+R_{TH})$.

Since $V_{+(25)}<V_-$, the output of comparator COMP attains a low level. Similarly, at T=155° C., $V_{+(155)}=V_-=2.5$ V. $V_+>V_-$ is established at the time point where the temperature exceeds 155° C., so that the output of compactor COMP attains an high level.

By monitoring the output of compactor COMP, determination can be made that the ink heating temperature $T_i$ has exceeded 155° C. by the transition from a low level to a high level. Also, determination can be made that the ink between temperature $T_i$ has become lower than 155° C. at the transition from a high level to a low level.

Figure 17:
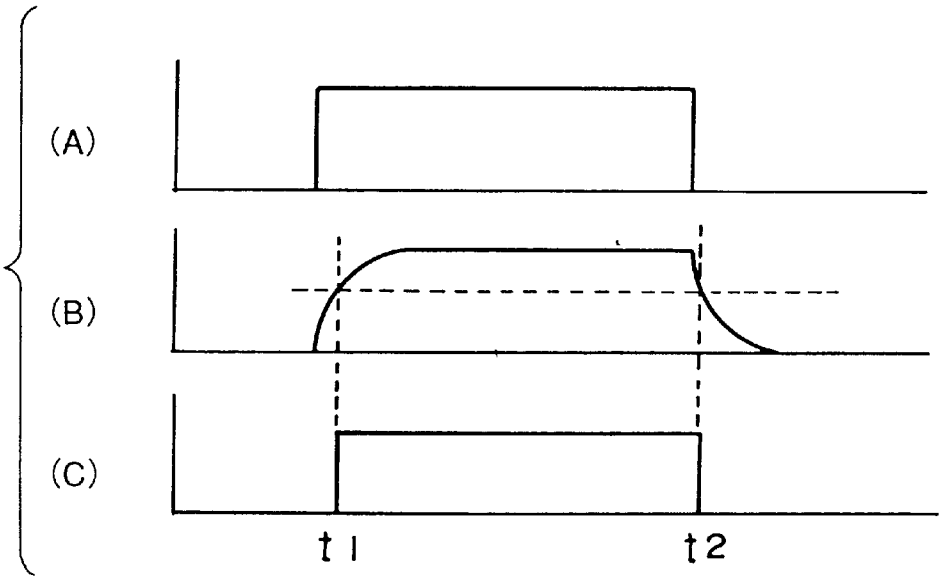
FIG. 17 shows an operation of a temperature sense device according to the first embodiment of the present invention.

FIG. 17 shows such a transition. FIG. 17(A) shows the timing of driving heater device 2. FIG. 17(B) shows the output signal from the thermistor. Since the resistance value of the thermistor becomes lower as the temperature rises, the signal voltage from the connection node of the thermistor and the resistor in FIG. 15 gradually increases. At time t1 when the signal voltage from the connection node of the thermistor and the resistor exceeds reference voltage value $V_{REF}$ connected to the inverting input of the comparator, the output of comparator COMP shows a transition from a low level to a high level as shown in FIG. 17(C).

Then, heater device 2 is controlled to maintain a constant temperature by temperature control device 16. Therefore, the signal voltage from the connection node of the thermistor and the resistor is also constant. The output of comparator COMP still attains a high level. The temperature of the head gradually becomes lower when the drive of heater device 2 is suppressed at completion of printing. Accordingly, the output voltage of the connection node of the thermistor and the resistor gradually becomes lower. At time $t_2$ when the signal voltage from the connection node of the thermistor and the resistor becomes lower than reference voltage value $V_{REF}$, the output of comparator COMP shows a transition from a high level to a low level.

Although the above description is provided for the case where the ink heating temperature is 155° C., the thermistor resistance value at T=60° C. can be obtained by FIG. 16 when the monitoring temperature is T=60° C. and use a value thereof for resistor R.

By setting a temperature where the amount of gaseous ink within the ink chamber becomes sufficiently reduced by liquidification as the monitoring temperature, and detecting the fall of the output signal obtained from comparator COMP, the state where the amount of gaseous ink within the ink chamber is sufficiently reduced can be detected. By controlling electric field shutters so that the voltage applied to all electric field shutter 8B is 0 V with the fall of the output signal obtained from the comparator as a trigger, ink leakage after completion of printing can be prevented.

(2) Ink recording apparatus employing a cooling head

A cooling head is a head where ink heating temperature $T_i$≈ink discharge portion temperature $T_s$ due to the superior thermal conductivity of an ink head. This head can prevent undesired ink discharge by providing a cooling device that cools the ink discharge portion. The cooling head can be realized using a material of superior thermal conductivity for the ink head material. For example, a head formed of Al and the like so that the thermal capacity of the head is small is applicable.

Figure 19:
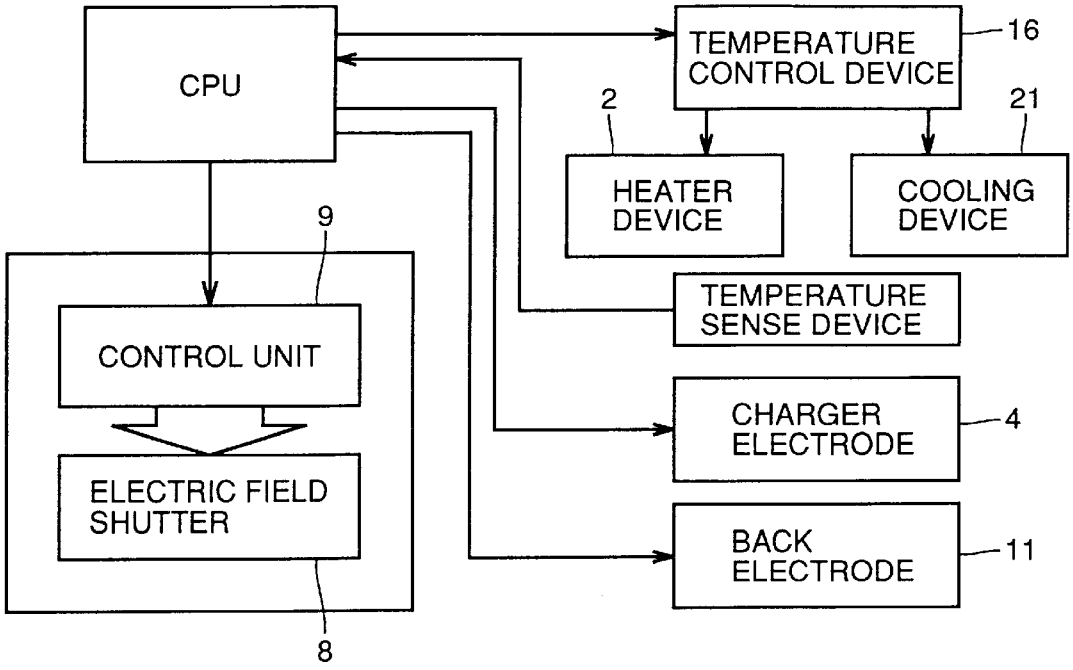
FIG. 19 shows the main signal flow of an image recording apparatus employing a cooling head according to the first embodiment of the present invention.
Figure 20:
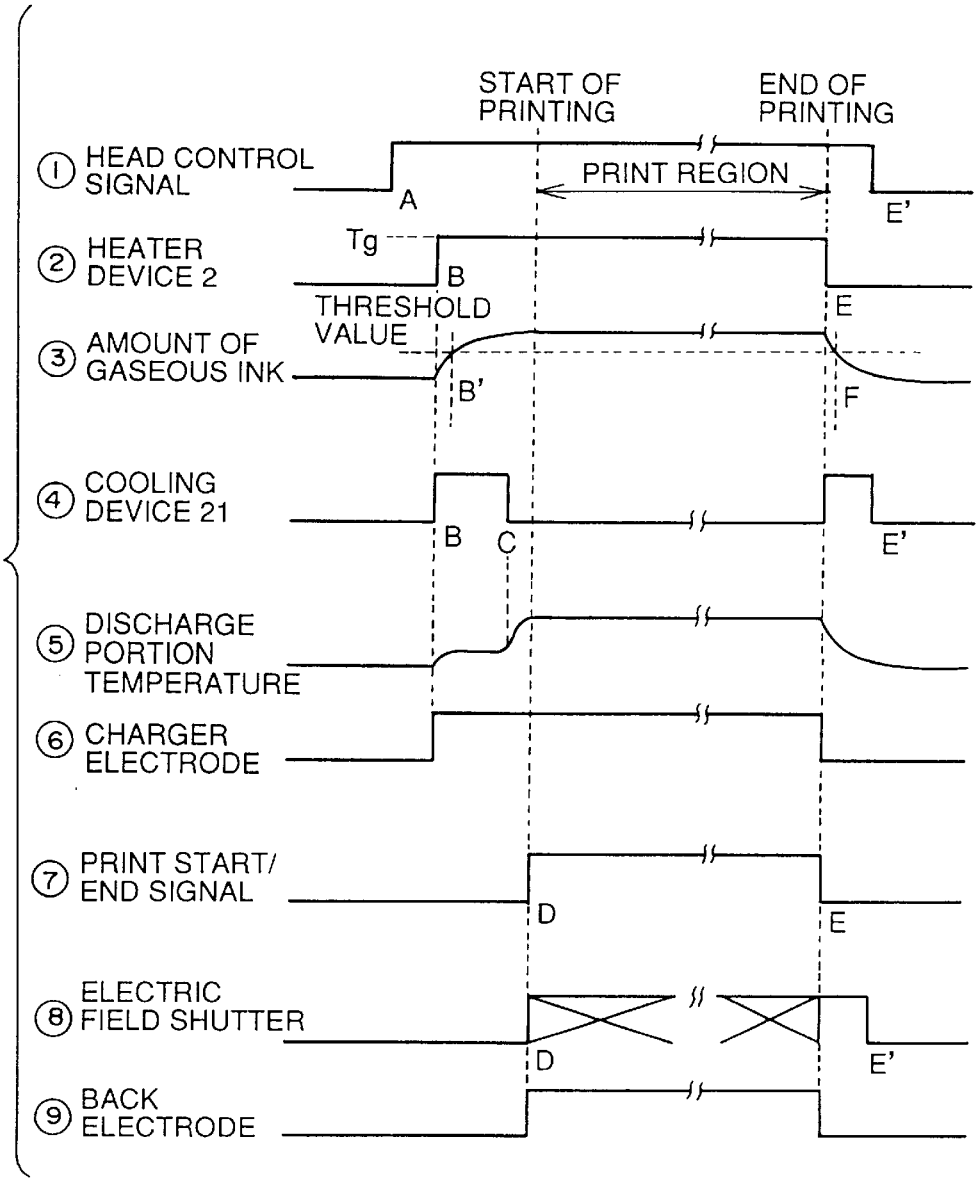
FIG. 20 is a timing chart showing an operation of an image recording apparatus employing a cooling head according to the first embodiment of the present invention.

An image recording apparatus employing a cooling head according to the first embodiment of the present invention will be described hereinafter with reference to FIGS. 18, 19 and 20. When a head control signal is provided from the CPU, heater device 2 in print head 101 is energized to heat ink 3. Ink 3 begins to be gasified at the ink vaporization temperature, for example $T_g$=140° C. to eventually fill print head 1 with gaseous ink 3B (after point C). Since print head 101 is sealed other than through ink discharge hole, gasified ink 3B attaining a high pressure will easily leak out from the ink discharge hole.

Figure 18:
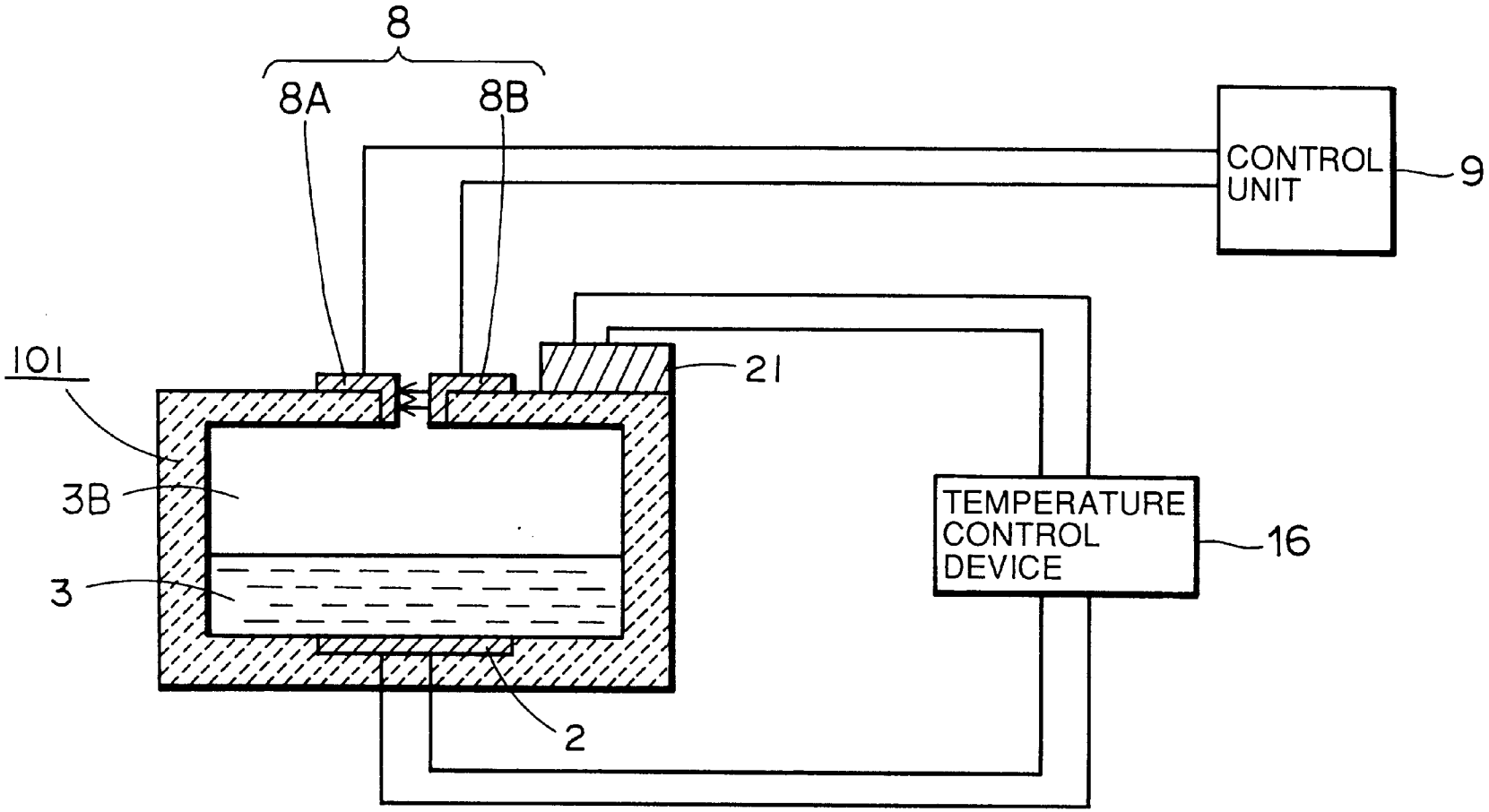
FIG. 18 shows an entire structure of an image recording apparatus employing a cooling head according to the first embodiment of the present invention.
Figure 21:
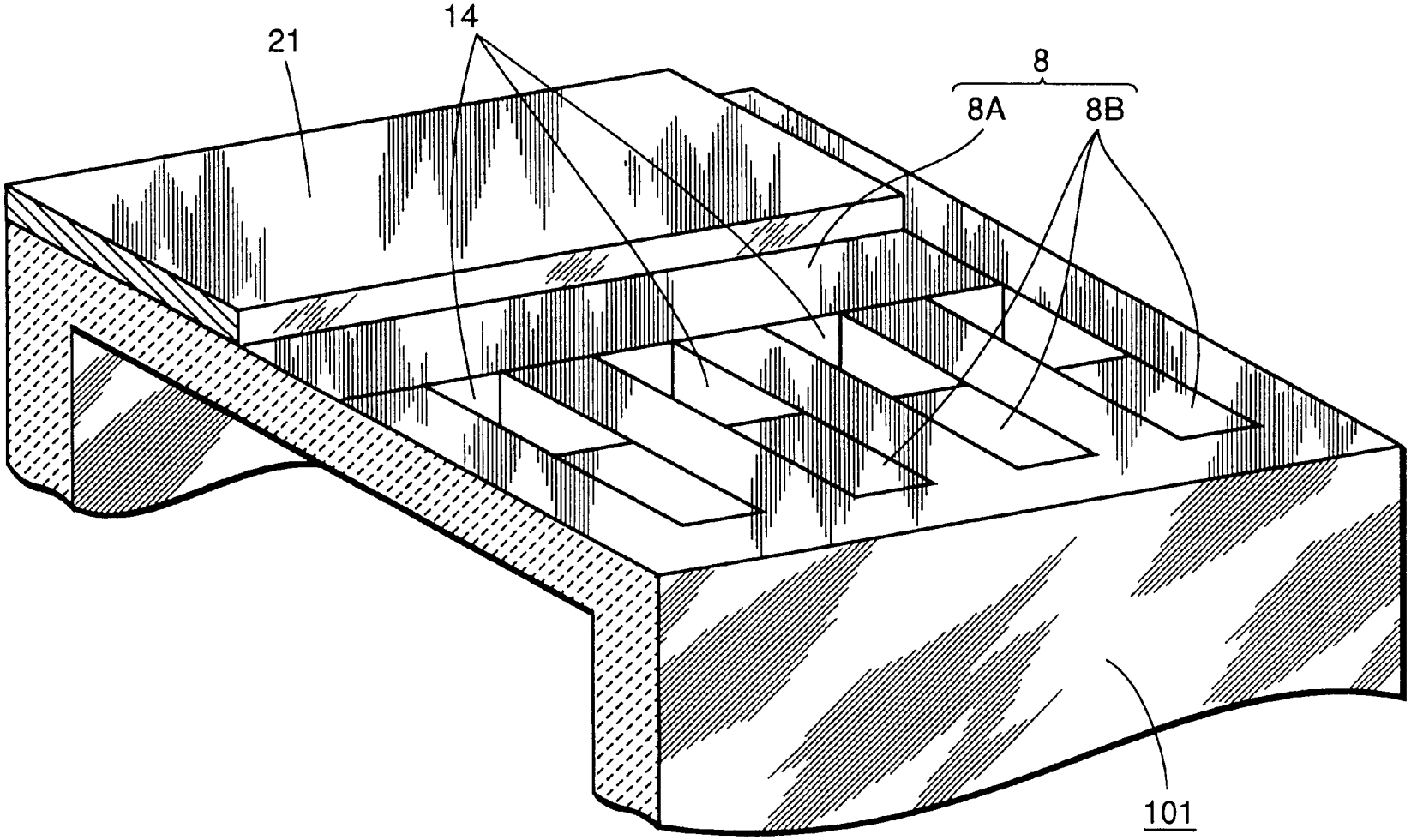
FIG. 21 is a perspective view of main components of a image recording apparatus employing a cooling head according to the first embodiment of the present invention.

In the image recording apparatus employing a cooling head according to the first embodiment, the temperature in the proximity of the ink discharge hole is lowered by a cooling device 21 such as a Peltier element, as shown in FIG. 18. FIG. 21 is a perspective view of the main components thereof.

Referring to FIG. 20 again, simultaneous to initiation of heating ink 3 by heater device 2 in print head 1 at point B in response to a head control signal output from the CPU, temperature control device 16 drives cooling device 21, for example, to cool the ink discharge portion to prevent the temperature thereof from rising. If the ink discharge portion is not cooled, temperature $T_s$ of the ink discharge portion will rise to a temperature in the vicinity of the heating temperature of heater device 2, for example up to 145° C. when ink heating temperature $T_i$=160° C. due to the high thermal conductance of the head. However, a Peltier element is arranged at the upper portion of the ink head where the ink discharge hole is formed. Control is provided by temperature control device 16 to be sufficiently lower than the vaporization temperature, for example to $T_s$=100° C. Therefore there is no ink leakage prior to commencing printing.

By providing control so that a voltage of 500 V (H), for example, is applied to electric field shutter 8B at an arbitrary time point prior to gasification of ink 3B, ink can be blocked reliably. The time point of applying the voltage of 500 V (H) to electric field shutter 8B may be simultaneous to energization of heater device 2, or may be effected during the period after output of a print start signal and until energization of heater device 2. An electric field is formed between electric field shutter 8A and electric field shutter 8B, which prevents passage of ink 3B through electric field shutter 8 even if charged gaseous ink 3B is present in print head 101.

Temperature control device 16 controls heater device 2 so that ink heating temperature $T_i$=is constant at 160° C., and cooling device 21 so that the ink discharging portion temperature $T_s$ is constant at 100° C. In this case, the difference between the ink heating temperature and the ink discharge portion temperature is $\Delta T=T_i-T_s=60°$ C. Since the ink discharging portion temperature is 145° C. when cooling device 21 is not operated, the cooling capability of 145−100=45° C. is sufficient for cooling device 21.

The amount of gaseous ink is increased at the elapse of the ink heating time. Control is provided so that temperature control device 16 inhibits the cooling operation of the ink discharge portion by cooling device 21 at time point C where a sufficient amount of gaseous ink 3B for discharge is generated. When the cooling operation of cooling device 21 is inhibited and the temperature of the ink discharge portion increases to an ink discharge enable temperature, for example $T_s$=145° C. at point D, a voltage according to image data is applied to electric field shutter 8B to initiate ink discharge, i.e. printing.

It is effective to form the ink head entirely by a single member of high thermal conductance in order to reduce the time period for the ink discharge portion to attain the ink discharge enable temperature after cessation of the cooling operation by cooling device 21.

By providing control so that the temperature of the ink discharge portion is reduced during the period from the heating operation of heater device 2 up to commencement of a printing operation, the problem of character blur due to ink leakage at time point B - D prior to initiation of a print operation is eliminated. By providing control so that a voltage is applied to electric field shutter 8B at a time point prior to gasification of ink 3B, ink can be blocked further reliably.

Heater device 2 and cooling device 21 may be constantly driven when the power of the image recording apparatus is turned on and have cooling device 21 turned off only during printing.

The method of controlling the ink discharge portion temperature and the electric field shutter after printing is completed will be described hereinafter. At time point E when the printing operation ends, gaseous ink 3B of high pressure remains in print head 101. Therefore, temperature control device 16 drives cooling device 21 to lower the temperature in the proximity of the ink discharge hole. However, there is a possibility that ink 3B attaining a high energy state will leak out from the ink discharge hole regardless of the value of the back electrode when the operation of electric field shutter 8 is turned off since there is a time period until the cooling temperature of T=50° C., for example, is attained. Therefore, control is provided to prevent ink leakage by driving cooling device 21 of a Peltier element to lower the temperature in the proximity of the ink discharge hole and apply a voltage to all the control electrodes in electric field shutter 8 when there is gaseous ink 3B (high energy state) in print head 101 even after the printing operation ends. By deenergizing heater device 2, gaseous ink 3B is effectively cooled by the heat dissipation of the heat radiation plate and the cooling effect of cooling device 21. The ink will gradually lose its kinetic energy.

The ink will attain a mist phase, and then a liquid phase, and then in some cases, a solid phase. Ink of a mist phase, as well as a liquid phase or a solid phase, is extremely reduced in its kinetic energy. The problem of ink leakage is eliminated in the circumstance where there is no difference between the outside pressure and the inside pressure of print head 101.

As described above, unrequired ink discharge can be prevented by identifying the temperature of this state by experiments in advance and turning electric field shutter 8 off, i.e. setting the voltage applied to all electric field shutters 8B to 0 V (L) when the signal from the temperature-voltage conversion circuit calibrated by a temperature sense apparatus such as a thermistor reaches an appropriate temperature, for example T=60° C.

Heater device 2 and cooling device 21 may be constantly driven when the power of the image recording apparatus is turned on and have cooling device 21 turned off only during a printing operation, as described before.

Although a control method using a Peltier element is described in the image recording apparatus employing a cooling device was described, a radiation plate can be employed as a simple cooling method, for example. It is to be noted that one of a great size is required if the cooling capability is to be increased. As an alternative, a heat pipe can be used. Although a heat pipe is superior in its cooling capability than a radiation plate, the structure is complex. Furthermore, accurate setting of the cooling temperature cannot be effected by the heat pipe or the radiation plate. The Peltier device allows the cooling temperature to be set to an arbitrary temperature by current control. However, it is expensive. An appropriate component should be used taking into consideration, its character, performance, and cost.

According to the invention of the first embodiment, advantages as set forth in the following can be obtained. By providing an ink head so that the temperature of the ink discharge hole becomes lower than the ink heating temperature, ink leakage caused by increase in pressure in the head can be prevented. When an ink head is employed where the temperature of the ink discharge hole becomes substantially equal to the ink heating temperature, provision of a cooling device provides the effect of preventing ink leakage. By appropriately controlling the temperature of the ink discharge hole, ink leakage can be prevented and ink discharge can be carried out quickly.

By adding a second heater so that the temperature of the ink discharge hole becomes substantially equal to the ink vaporization temperature, generation of clogging can be reduced since the ink blocked by the shutter unit to adhere thereto can be sublimated again. The device of collecting the attached ink and a cleaning device are no longer required.

By providing control so that the electric field shutter is turned on prior to gasification of ink and also controlling the temperature of the ink discharge portion to correspond to the temperature characteristic of the head, the problem of ink being discharged prior to the ink discharge timing can be eliminated.

By turning off the electric field shutter at a time point when the temperature becomes lower than a certain temperature on the basis of a signal from temperature sense means at completion of a print operation, and controlling the temperature of the ink discharge portion, leakage of gaseous or mist-like ink particle remaining in the print head from the discharge hole can be prevented.

Second Embodiment

An image recording apparatus according to a second embodiment of the present invention will be described hereinafter.

Figure 22:
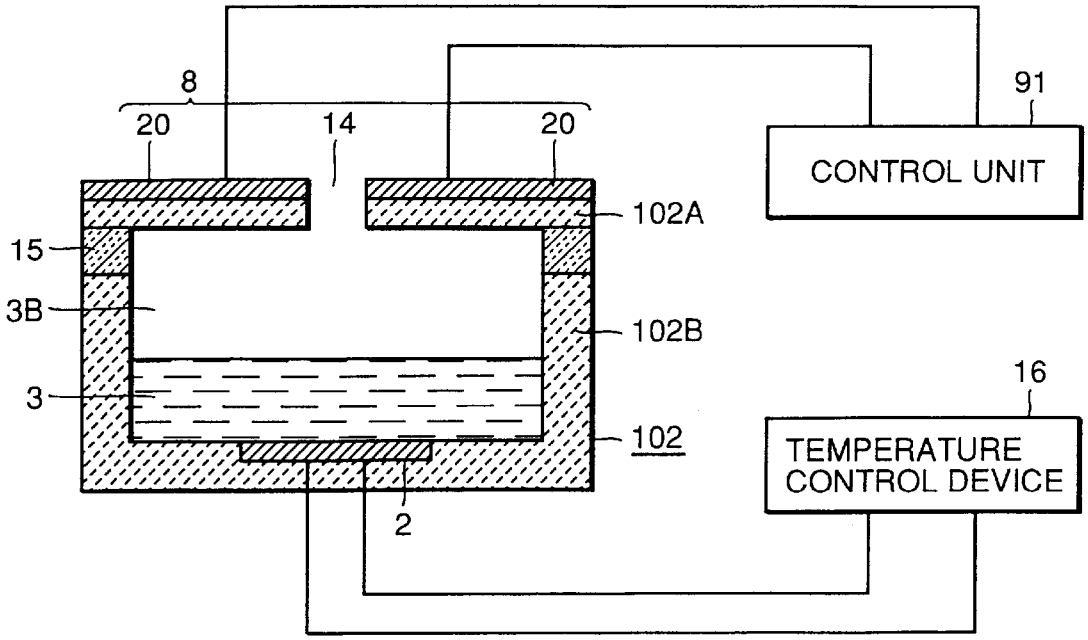
FIG. 22 shows an entire structure of an image recording apparatus according to a second embodiment of the present invention.
Figure 23:
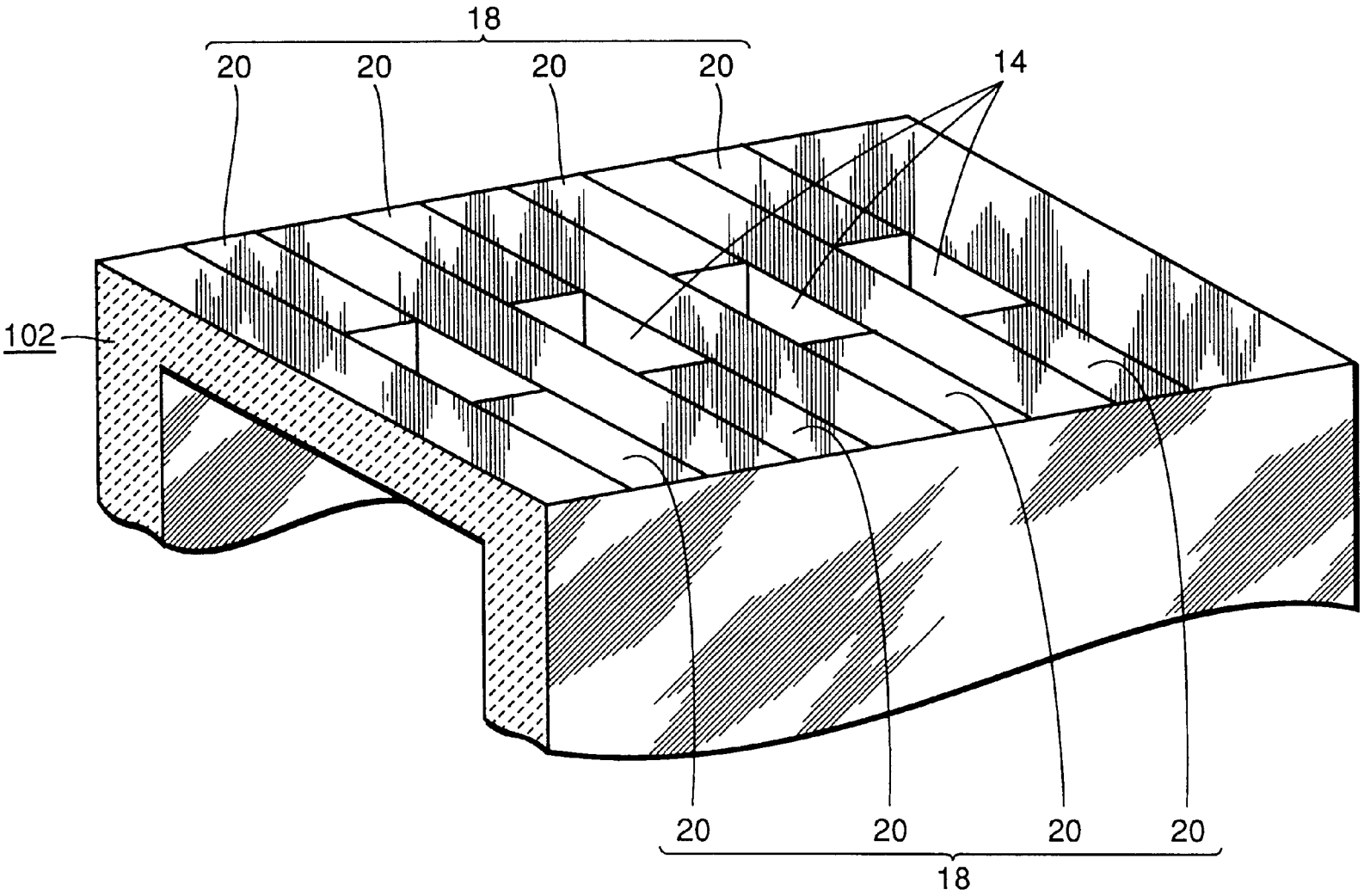
FIG. 23 is a perspective view of the main components of an image recording apparatus according to the second embodiment of the present invention.

Referring to FIG. 22, an image recording apparatus of the second embodiment includes an ink head lower portion 102B with ink 3 stored in a powder or liquid state and a heater device 2 for heating ink 3, an ink head upper portion 102A with a heater group 20 as a thermal shutter, and a thermal insulation member 15 provided between ink head upper portion 102A and ink head lower portion 102B for thermally isolating upper portion 102A from lower portion 102B. Referring to FIG. 23, a thermal shutter 18 includes a plurality of heaters 20 provided in a comb-like manner at the interval of 169 $\mu$m with respect to the plurality of discharge holes when discharge hole 14 of vaporized ink 3B are provided at an interval corresponding to the recording density, for example, 150 dot/inch.

Figure 24:
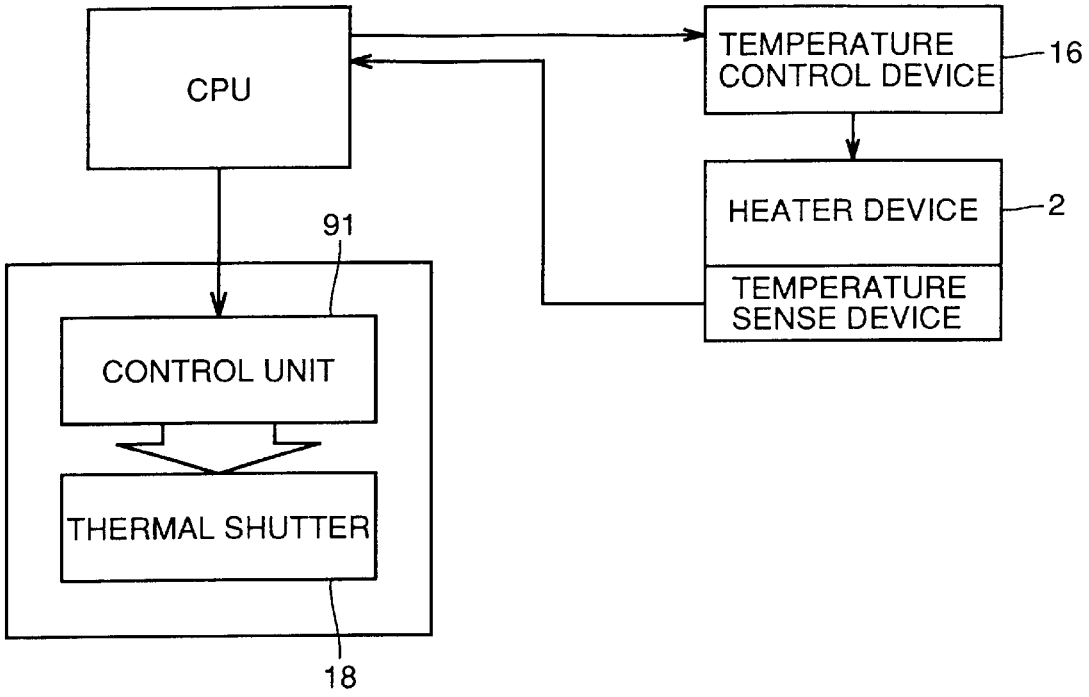
FIG. 24 shows a main signal flow of an image recording apparatus according to the second embodiment of the present invention.
Figure 25:
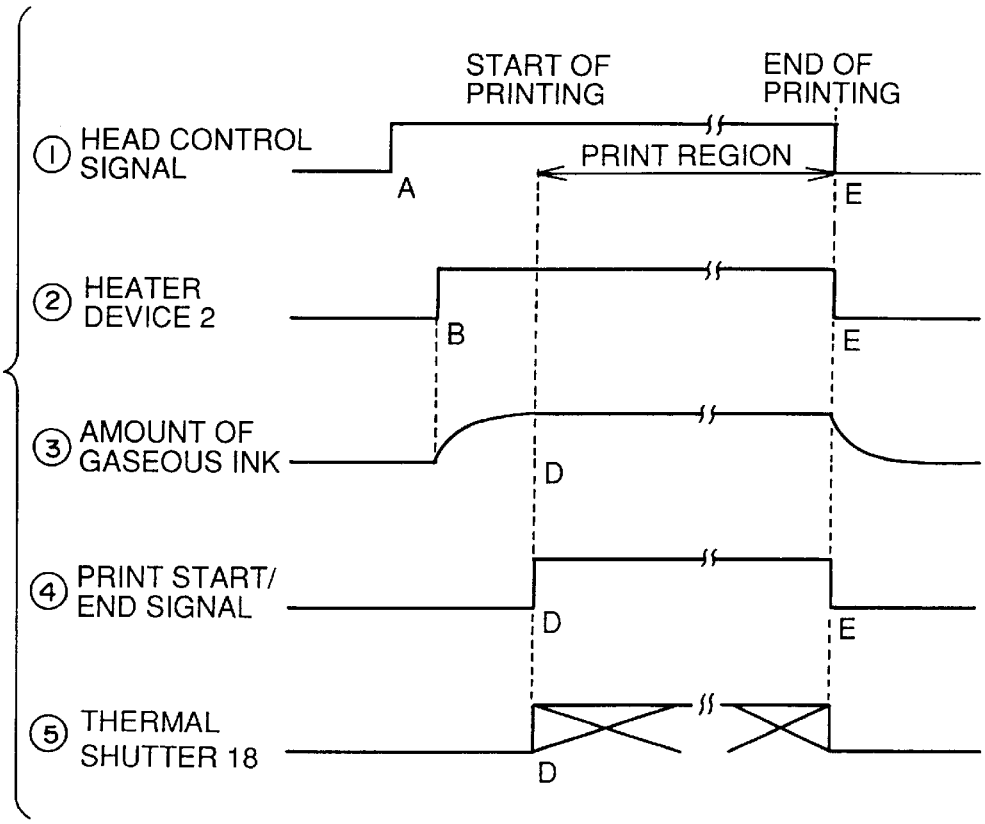
FIG. 25 is a timing chart showing the operation of an image recording apparatus according to the second embodiment of the present invention.

The operation of the image recording apparatus of the second embodiment will be described hereinafter with reference to FIGS. 24 and 25. When a print command is issued to the image recording apparatus from an operator or another information equipment, a head control signal is transmitted from the CPU of the image recording apparatus to head 102. The head control signal indicates a disable state and an enable state of the head when at a low level and a high level, respectively. Temperature control device 16 drives heater device 2 at point B triggered by the rise (point A) of the head control signal. As a result, solid or liquid ink 3 is heated to attain a gaseous phase when the ink vaporization temperature $T_g$ is exceeded. The amount of gaseous ink 3B increases over time. Temperature control device 16 controls heater device 2 so that ink heating temperature $T_i$ becomes lower than ink vaporization temperature $T_g$. For example, when ink vaporization temperature $T_g$ is 140° C. at $T_i=T_g+\Delta T$, control is provided so that $T_i$=155° C. with $\Delta T$=15° C.

The image recording apparatus of the second embodiment employs a heating head. There is a great temperature difference between the ink head low portion and the ink discharge portion even when the temperature of ink head lower portion 102B is higher than the ink vaporization temperature. Therefore, when ink discharge portion temperature $T_s$=becomes as low as 60° C., ink will not be discharged even when heater device 2 is driven, as described with reference to the first embodiment.

The CPU generates a print start/end signal when the temperature of the ink detected by a temperature sense device provided in the ink head arrives at a target temperature, for example T=155° C. This print start/end signal indicates a print disable state and a print enable state of the head at a low level and a high level, respectively.

Triggered at the rise of the print start/end signal, image data is transmitted from a memory not shown to a control unit 91. Data can be transmitted in a serial or parallel format. When data transfer of one line from the memory is completed, control unit 91 latches the data and provides an ON/OFF signal according to image data to the electrode of the plurality of heaters 20 forming thermal shutter 18.

Thermal shutter 18 is connected to a power source not shown that supplies a current of several amperes. A current of several mili amperes to several ten mili amperes is turned on/off with respect to one heater electrode according to image data. The value of the current supplied to one heater electrode is set so that the temperature of the ink discharge portion rises to an ink discharge enable temperature, for example $T_s$=145° C. More specifically, no current is supplied to heater 20 provided for the purpose of controlling the temperature of the discharge hole corresponding to a non-printing pixel, and a current of several milliamperes to several ten milliamperes is supplied to heater 20 of the discharge hole corresponding to a pixel that is to be printed.

As described in the first embodiment, the temperature of the ink discharge portion is sufficiently lower than the temperature of the ink heating portion when heater 20 thereof is off. Therefore, gaseous ink 3B will not leak out through thermal shutter 18. When heater 20 is on, the temperature of the ink discharge portion becomes equal to the temperature of the ink heating portion. Therefore, ink 3B will pass through thermal shutter 18. In this case, thermal shutter 18 functions in an OFF state. By controlling the temperature of the ink discharge portion, ink discharge can be controlled. By controlling independently the plurality of heaters provided corresponding to each of the pixels, the passage of gaseous ink 3B can be controlled in the unit of a pixel.

Since the head is formed so that the temperature of the ink discharge portion becomes lower than the ink heating temperature, the problem of character blur due to ink leakage at points B to D prior to print commencement is eliminated. By selectively controlling heating of the temperature of the ink discharge portion, selective printing can be carried out since ink is discharged from a discharge hole where the temperature is increased.

During printing, heater device 2 is operated to generate gaseous ink and a current is selectively supplied to the plurality of control electrodes of the thermal shutter. Ink discharge and blocking can be controlled by controlling the temperature of a desired ink discharge portion.

The control method of the thermal shutter after print completion will be described hereinafter. At time point E where a printing operation ends, the print start/end signal attains a low level. In response, heater device 2 and thermal shutter 18 are entirely turned off. Although gaseous ink 3B of high pressure remains in print head 1 when printing ends, the temperature of the ink discharge portion is immediately cooled down when the current applied to all the heater electrodes of thermal shutter 18 is inhibited since the ink discharge portion is formed of a material of superior thermal conductance. Therefore, ink will not be discharged.

In the first embodiment, the discharge/blocking method of ink was implemented by electrical control of charged ink with an electric field shutter. A voltage source of high voltage is required as a source for driving the electric field shutter. In the second embodiment, control of gaseous ink discharge/blocking is effected by controlling the temperature of the discharge portion using a heater. Therefore, the power source for driving thermal shutter 18 is a current source.

In the ink discharge control method according to an electric field shutter, a second heater or cooling device is required in addition to an electric field shutter of a control electrode and a common electrode around the discharge portion. In the ink discharge control method by a thermal shutter, only a group of heaters is required as the shutter. This is advantageous from the standpoint of a simple structure.

The invention according to the second embodiment provides advantages set forth in the following. By on/off control of the temperature of the ink discharge portion, ink can be discharged intermittently. By forming the thermal shutter portion with a group of heaters according to the resolution and controlling the on/off of each heater, ink can be discharged intermittently.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image recording apparatus comprising:

a discharge head, wherein said discharge head comprises an ink chamber having a discharge hole, a first heater for heating and gasifying ink in said ink chamber, a charger electrode for charging said ink, a back electrode disposed opposite to said discharge hole at a backside of a recording medium arranged facing said discharge hole for inducing charged gasified ink towards said recording medium side, a shutter unit provided at said discharge hole for discharging gasified ink intermittently according to an electrical signal corresponding to image data to be recorded, and first means for maintaining (i) a temperature of said discharge hole or (ii) a temperature of a head member in a proximity of said discharge hole, $T_s$, sufficiently lower than a temperature of said first heater in operation of said first heater before initiation and after completion of image data recording, said first means comprising a temperature control device connected to said first heater for controlling the temperature of said discharge hole or said head member relative to the temperature of said first heater, said image recording apparatus further comprising a discharge control device for controlling said shutter unit.

2. The image recording apparatus according to claim 1, wherein said first means comprises a thermal insulation member provided between said first heater and said shutter unit for thermally isolating said first heater from said shutter unit.

3. The image recording apparatus according to claim 2, wherein said discharge head further comprises a second heater coupled to said shutter unit for heating said shutter unit until (i) the temperature of said discharge hole or (a) (ii) the (head) temperature of the head member in (a) the proximity of said discharge hole, $T_s$, becomes substantially equal to the temperature of said first heater.

4. The image recording apparatus according to claim 3, wherein said discharge head further comprises temperature sense means for sensing (i) the temperature of said discharge hole or (a) (ii) the temperature of the head member in (a) the proximity of said discharge hole, $T_s$.

5. The image recording apparatus according to claim 4, further comprising a temperature control device for controlling the temperature of said discharge hole according to a signal from said temperature sense means.

6. The image recording apparatus according to claim 5, wherein said temperature control device controls (i) the temperature of said discharge hole or (a) (ii) the temperature of the head member in (a) the proximity of said discharge hole, $T_s$, so that (a) the temperature has a constant temperature difference $\Delta T$ (>0) from a temperature $T_i$ of said first heater as $T_s=T_i-\Delta T$.

7. The image recording apparatus according to claim 2, wherein said discharge head further comprises temperature sense means for sensing (i) the temperature of said discharge hole or (a) (ii) the temperature of the head member in (a) the proximity of said discharge hole, $T_s$.

8. The image recording apparatus according to claim 7, further comprising a temperature control device for controlling (i) the temperature of said discharge hole or (a) (ii) the temperature of the head member in (a) the proximity of said discharge hole, $T_s$, according to a signal from said temperature sense means.

9. The image recording apparatus according to claim 8, wherein said temperature control device controls (i) the temperature of said discharge hole or (a) (ii) the temperature of the head member in (a) the proximity of said discharge hole, $T_s$, so that (a) (i) the temperature of said discharge hole or (a) (ii) the temperature of the head member in (a) the proximity of said discharge hole, $T_s$, has a constant temperature difference $\Delta T$ (>0) from a temperature $T_i$ of said first heater as $T_s=T_i-\Delta T$.

10. The image recording apparatus according to claim 1, wherein said discharge head further comprises a second heater for heating said shutter unit until (i) the temperature of said discharge hole or (a) (ii) the temperature of the head member in (a) the proximity of said discharge hole, $T_s$, becomes substantially equal to the temperature of said first heater.

11. The image recording apparatus according to claim 10, wherein said discharge head further comprises temperature sense means for sensing (i) the temperature of said discharge hole or (ii) the temperature of head member in the proximity of said discharge hole, $T_s$.

12. The image recording apparatus according to claim 11, further comprising a temperature control device for controlling (i) the temperature of said discharge hole or (ii) the temperature of the head member in the proximity of said discharge hole according to a signal from said temperature sense means.

13. The image recording apparatus according to claim 12, wherein said temperature control device controls (i) the temperature of said discharge hole or (ii) the temperature of the head member in the proximity of said discharge hole, $T_s$, so that (a) (i) the temperature of said discharge hole of (ii) the temperature of the head member in the proximity of said discharge hole, $T_s$, has a constant temperature difference $\Delta T$ (>0) from a temperature $T_i$ of said first heater as $T_s=T_i-\Delta T$.

14. The image recording apparatus according to claim 1, wherein said first means comprises a cooling device provided in a proximity of said discharge hole for cooling so that (i) the temperature of said discharge hole or (a) (ii) the temperature of the head member in (a) the proximity of said discharge hole becomes sufficiently lower than the temperature of said first heater.

15. The image recording apparatus according to claim 14, wherein said discharge head further comprises temperature sense means for sensing (i) the temperature of said discharge hole or (a) (ii) the temperature of the head member in (a) the proximity of said discharge hole, $T_s$.

16. The image recording apparatus according to claim 15, further comprising a temperature control device for controlling (i) the temperature of said discharge hole or (a) (ii) the temperature of the head member in (a) the proximity of said discharge hole, $T_s$, according to a signal from said temperature sense means.

17. The image recording apparatus according to claim 16, wherein said temperature control device controls (i) the temperature of said discharge hole or (a) (ii) the temperature of the head member in (a) the proximity of said discharge hole so that (a) (i) the temperature of said discharge hole or (a) (ii) the temperature of the head member in (a) the proximity of said discharge, $T_s$, has a constant temperature difference $\Delta T$ (>0) from a temperature $T_i$ of said first heater as $T_s=T_i-\Delta T$.

18. The image recording apparatus according to claim 1, wherein said discharge head further comprises temperature sense means for sensing (i) the temperature of said discharge hole or (ii) the temperature of the head member in (a) the proximity of said discharge hole, $T_s$.

19. The image recording apparatus according to claim 18, further comprising a temperature control device for controlling (i) the temperature of said discharge hole or (a) (ii) the temperature of the head member in (a) the proximity of said discharge hole, $T_s$, according to a signal from said temperature sense means.

20. The image recording apparatus according to claim 19, wherein said temperature control device controls (i) the temperature of said discharge hole or (a) (ii) the temperature of the head member in (a) the proximity of said discharge hole so that (i) the temperature of said discharge hole or (a) (ii) the temperature of the head member in (a) the proximity of said discharge hole, $T_s$, has a constant temperature difference $\Delta T$ (>0) from a temperature $T_i$ of said first heater as $T_s=T_i-\Delta T$.

21. An image recording apparatus comprising:

a discharge head, wherein said discharge head comprises an ink chamber having a discharge hole, a heater for heating and gasifying ink in said chamber, a thermal shutter unit for discharging gasified ink intermittently according to an electrical signal corresponding to image data to be recorded by heating, and which, by inhibiting heating, controls (i) a temperature of said discharge hole or (i) a temperature of a head member in a proximity of said discharge hole to become substantially equal to a temperature of said heater, and a temperature control device connected to said first heater for controlling the temperature of said discharge hole or said head member relative to the temperature of said first heater.

22. An image recording apparatus according to claim 21, wherein at least a portion of said discharge head in the proximity of said discharge hole is formed of a material which has a thermal conductivity higher than a predetermined value.

23. An image recording apparatus comprising:

a discharge head, wherein said discharge head comprises an ink chamber having a discharge hole, a heater provided at a lower portion of said ink chamber, a charger electrode provided in said ink chamber, a back electrode disposed opposite said discharge hold at a backside of a recording medium arranged facing said discharge hole, a thermal shutter unit provided at said discharge hole, and a thermal insulation member provided between said heater and said thermal shutter unit, and said image recording apparatus comprising a discharge control device connected to said thermal shutter unit, said control device connected to said first heater for controlling the temperature of said discharge hole or said head member relative to the temperature of said first heater.

24. An image recording apparatus comprising:

a discharge head, wherein said discharge head comprises an ink chamber having a discharge hole, a first heater provided at a lower portion of said ink chamber, a charger electrode provided in said ink chamber, a back electrode disposed opposite said discharge hole at a backside of a recording medium arranged facing said discharge hole, a shutter unit provided at said discharge hole, and a second heater provided in a proximity of said shutter unit, and said image recording apparatus comprising a discharge control device connected to said shutter unit, further comprising a temperature control device for controlling (i) a temperature of said discharge hole or (ii) a temperature of a head member in a proximity of said discharge hole, $T_s$, sufficiently lower than a temperature of said first heater in operation of said first heater before initiation and after completion of image data recording, said temperature control device connected to said first heater for controlling the temperature of said discharge hole or said head member relative to the temperature of said first heater.

* * * * *